US007240654B2

(12) United States Patent
Verdial

(10) Patent No.: US 7,240,654 B2
(45) Date of Patent: Jul. 10, 2007

(54) ENGINE VALVE ASSEMBLY

(76) Inventor: Miguel Nuno Guimaraes Verdial, 110 Hershel Ct., Panama City, FL (US) 32404

( * ) Notice: Subject to any disclaimer, the term of this patent is extended or adjusted under 35 U.S.C. 154(b) by 0 days.

(21) Appl. No.: 10/867,300

(22) Filed: Jun. 14, 2004

(65) Prior Publication Data

US 2005/0274348 A1 Dec. 15, 2005

(51) Int. Cl.
*F01L 7/00* (2006.01)

(52) U.S. Cl. ..... 123/190.4

(58) Field of Classification Search ..... 123/190.4, 123/190.12, 190.16, 80 C, 80 BA, 190.6
See application file for complete search history.

(56) References Cited

U.S. PATENT DOCUMENTS 1,299,264 A * 4/1919 Thayer ..... 123/80 BA
3,948,227 A * 4/1976 Guenther ..... 123/258
5,706,775 A * 1/1998 Schweter et al. ..... 123/190.12

OTHER PUBLICATIONS

Internet Article entitled How Car Engines Work, Internal Combustion, by Marshall Brain dated Apr. 23, 2004, 1 Page.
Internet Article entitled How Car Engines Work, Other Parts of an Engine, by Marshall Brain dated Apr. 23, 2004, 2 Pages.
Internet Article entitled How Car Engines Work, Valve Trains, by Marshall Brain dated Apr. 23, 2004, 1 Page.
Internet Article entitled How Two-Stroke Engines Work, Two-Stroke Basics, by Marshall Brain dated Apr. 23, 2004, 2 pages.
Internet Article entitled How Two-Stroke Engines Work, The Two Stroke Cycle, by Marshall Brain dated Apr. 23, 2004, 2 Pages.
Internet Article entitled Cruising, Four-Cylinder Car Engines, dated Apr. 29, 2004, 2 pages.

* cited by examiner

*Primary Examiner*—Stephen K. Cronin
*Assistant Examiner*—Hyder Ali
(74) *Attorney, Agent, or Firm*—Vidas, Arrett & Steinkraus, PA

(57) ABSTRACT

An inventive engine valve assembly may comprise a rotatable shaft having a fluid passageway extending therethrough, preferably in a direction orthogonal to the longitudinal axis of the shaft. The shaft may be positioned such that the fluid passageway is in communication with an engine cylinder during selected portions of shaft rotation. The shaft may be arranged to rotate with the crankshaft. When used as an intake valve, the valve may be arranged to allow fluid communication with the cylinder during an intake stroke. When used as an exhaust valve, the valve may be arranged to allow fluid communication with the cylinder during an exhaust stroke.

44 Claims, 22 Drawing Sheets

ENGINE VALVE ASSEMBLY

BACKGROUND OF THE INVENTION

This invention relates generally to engines, such as internal combustion engines, and more specifically to an intake and/or exhaust valve assembly and timing system for an engine.

Internal combustion engines are generally known. Many engines utilize at least one intake valve and at least one exhaust valve per cylinder. The valves are typically spring-loaded or biased in a normally closed configuration and are opened through a mechanical interaction with a camshaft.

The maximum engine speed or upper RPM limit in some engines may be controlled by the intake and exhaust valves and the related valve train. Inertia of the valve assemblies during the alternative movements can prevent the valves from opening or closing appropriately at high engine speeds, such as above redline.

Traditional valve assemblies may also substantially reduce the rated power output of the engine, as engine power must be used to operate the valve systems, which may include rotating camshafts, actuating rocker arms, compressing valve springs and actuating the moving mass of the valve and valve stem.

Further, traditional valve assemblies generally include many moving parts that may wear and eventually fail.

It would be desirable for an engine valve assembly to have fewer moving parts than traditional valve assemblies. It would further be desirable for an engine valve assembly to be capable of very high speed operation, and thus not limit the maximum speed of engine operation.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In one embodiment, a valve assembly for an internal combustion engine may comprise a rotatable shaft including a first fluid passageway. The shaft may be arranged to rotate according to the speed of an engine such that during a piston intake stroke, the first fluid passageway is in communication with a cylinder and allows air to enter the cylinder.

The valve assembly may further be arranged such that the first fluid passageway is not in communication with the cylinder during piston compression, combustion or exhaust strokes.

In some embodiments, the rotatable shaft may further comprise a second fluid passageway. During the piston exhaust stroke, the second fluid passageway may be in communication with the cylinder and allow exhaust to exit the cylinder. Preferably, the second fluid passageway is not in communication with the cylinder during piston intake, compression, or combustion strokes.

In some embodiments, the rotatable shaft is rotatably supported by the engine head, and intake air is arranged to pass through the head and rotatable shaft when the valve assembly is open.

The rotatable shaft may be positioned such that the longitudinal axis of the rotatable shaft is orthogonal to the longitudinal axis of the cylinder.

In some embodiments, the rotatable shaft may comprise a wall portion, a hollow interior portion, a first aperture in the wall portion in communication with the hollow interior portion, and a second aperture in the wall portion in communication with the hollow interior portion. When the valve is closed, the wall portion preferably prevents fluid flow from reaching a cylinder.

In another embodiment, a valve assembly for an internal combustion engine may comprise a first rotatable shaft having a wall surface and a first fluid pathway extending therethrough, and a second rotatable shaft having a wall surface and a second fluid pathway extending therethrough. The second rotatable shaft may be oriented concentrically within the first rotatable shaft. The valve assembly is open when the first fluid pathway and second fluid pathway are positioned to allow fluid communication with a cylinder. The valve assembly is closed when either the first fluid pathway or the second fluid pathway is not positioned to allow fluid communication with a cylinder.

The first fluid pathway may comprise a first aperture and a second aperture through the wall surface of the first rotatable shaft, and the second fluid pathway may comprise a third aperture and a fourth aperture through the wall surface of the second rotatable shaft. The first aperture and the second aperture may be located on opposite sides of the longitudinal axis of the first rotatable shaft. The third aperture and the fourth aperture may be located on opposite sides of the longitudinal axis of the second rotatable shaft. The first aperture and the second aperture may extend 90° about the circumference of the first rotatable shaft. The third aperture and the fourth aperture may extend 45° about the circumference of the second rotatable shaft.

The first rotatable shaft and the second rotatable shaft may rotate in the same direction or in opposite directions.

The second rotatable shaft may be arranged to rotate at ½ the rate of the first rotatable shaft.

The first rotatable shaft may be arranged to rotate at ½ the rate of an engine crankshaft.

In some embodiments, the first rotatable shaft may further comprise a third fluid pathway extending in a direction orthogonal to both the longitudinal axis of the first rotatable shaft and the first fluid pathway, and the second rotatable shaft may further comprise a fourth fluid pathway extending in a direction orthogonal to both the longitudinal axis of the second rotatable shaft and the second fluid pathway. An exhaust portion of the valve assembly is open when the third fluid pathway and fourth fluid pathway are in communication with a cylinder.

The exhaust portion of the valve assembly is preferably open during a piston exhaust stroke, and the exhaust portion of the valve assembly is preferably closed during piston intake, compression and combustion strokes.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
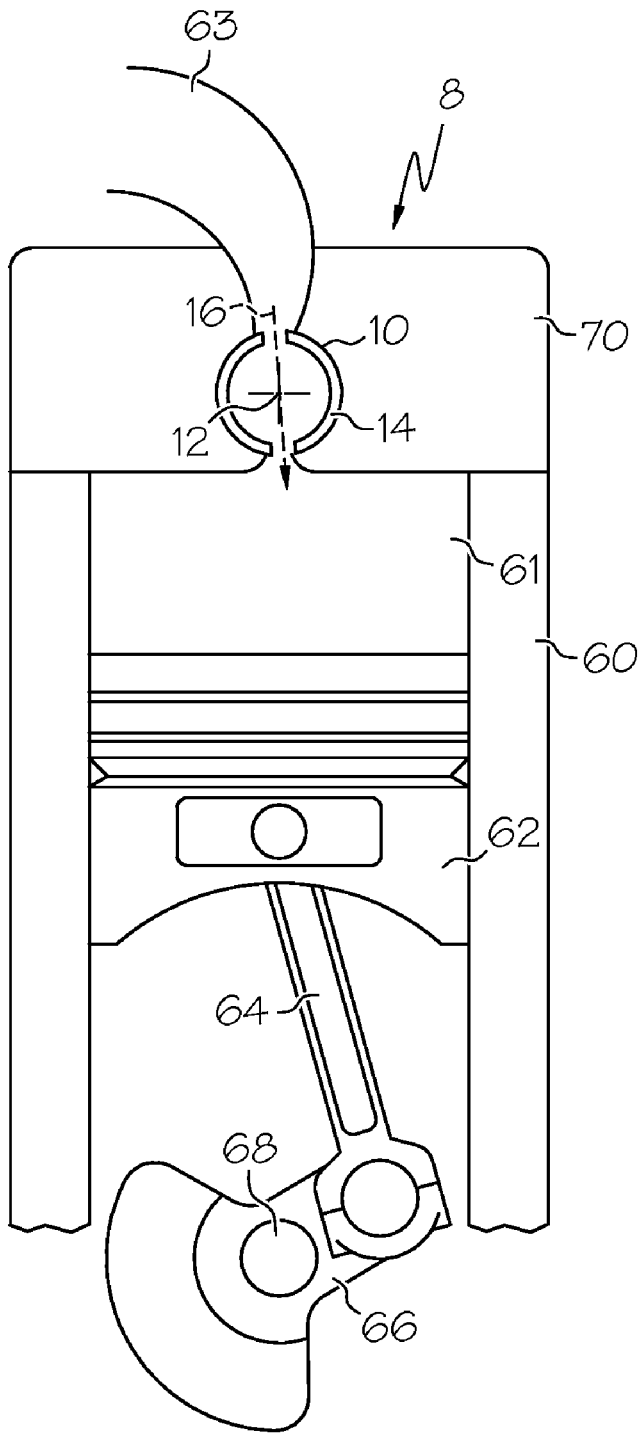
FIG. 1 shows a portion of an internal combustion engine and an embodiment of an inventive valve assembly.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows a portion of an engine with an inventive intake and/or exhaust valve assembly 8. The engine may comprise a block 60 having at least one cylinder 61. For each cylinder 61, a piston 62, connecting rod 64 and connecting rod bearing 66 may be provided, which may work to drive a crankshaft 68. A head 70 may be attached to the top of the block 60. The head 70 may support a valve shaft 10.

The valve shaft 10 may have a tubular shape and a longitudinal axis 12, and may be arranged to rotate about the longitudinal axis 12. The valve shaft 10 may be mounted such that the longitudinal axis 12 is orthogonal to a longitudinal axis of the cylinder 61. The valve shaft 10 may include a first fluid pathway or passageway 16. As the valve shaft 10 rotates, the first fluid passageway 16 may provide fluid communication between the cylinder 61 and an air intake 63 during a portion of the rotation wherein the valve 8 is open. During other portions of the rotation wherein the valve 8 is closed, the wall 14 of the valve shaft 10 may interrupt fluid communication between the cylinder 61 and the air intake 63. For example, the valve shaft 10 may be arranged to open during only the piston intake stroke, and may be closed during the compression, power and exhaust strokes.

Valve shafts 10 may be arranged to rotate in either direction about the longitudinal axis 12 of the valve shaft 10, as the direction of rotation will not alter performance of the valve 8. In embodiments of the invention which include multiple valve shafts 10, as described below, various valve shafts 10 may be arranged to rotate in opposite directions to help minimize external torquing effects.

In some embodiments, a valve shaft 10 may further comprise a second fluid pathway or passageway, as described below, which may be used to provide fluid communication between the cylinder 61 and an exhaust system during a piston exhaust stroke. For example, a first portion of length of the valve shaft may be used to form the first fluid passageway 16, and a second portion of length may be used to form the second fluid passageway.

In some embodiments, a valve shaft 10 may be used with multiple cylinder engines and may comprise separate intake and exhaust passageways along its length. Desirably, an intake passageway and an exhaust passageway may be provided for each cylinder.

Figure 3:
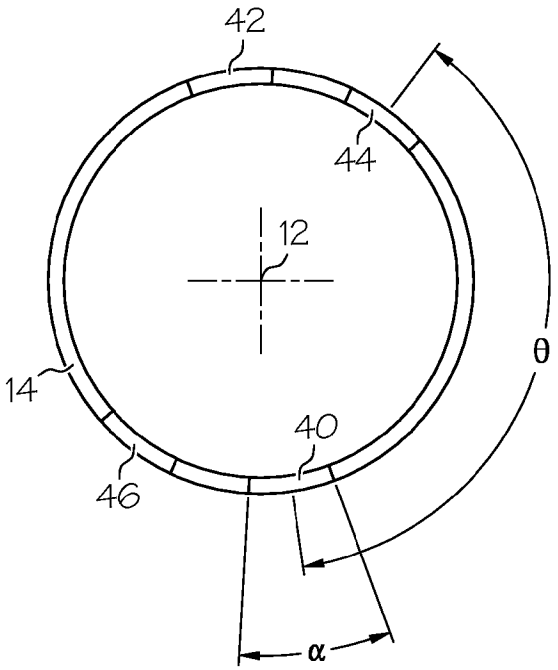
FIG. 3 is an end view of a rotatable shaft according to an embodiment of the invention.
Figure 2:
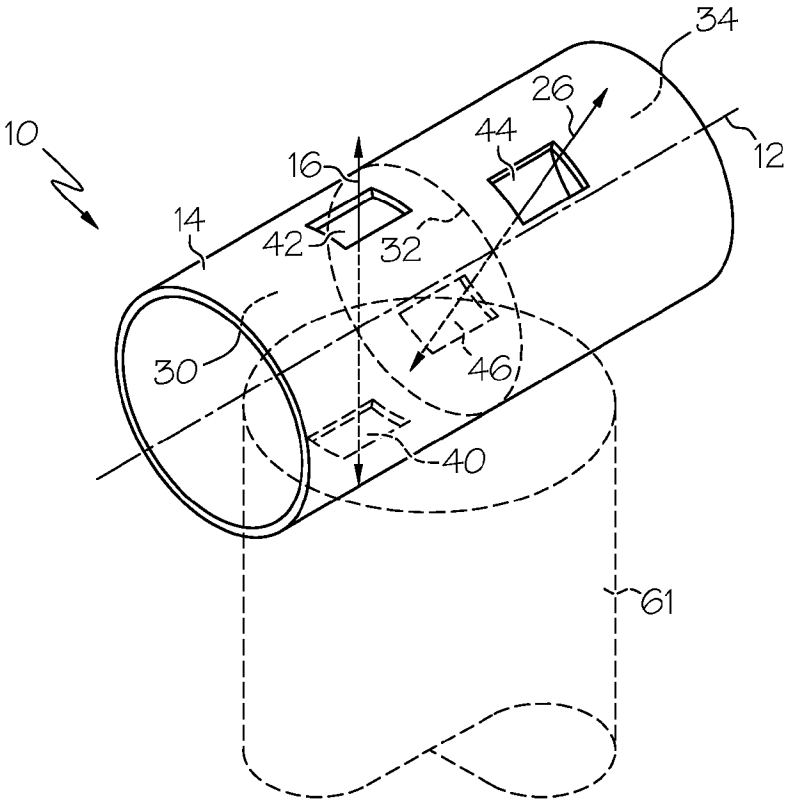
FIG. 2 shows a perspective view of an embodiment of an inventive valve assembly.

FIGS. 2 and 3 show an embodiment of an inventive valve shaft 10. The shaft 10 may have a tubular shape and a longitudinal axis 12. The shaft 10 may be used as an intake and/or exhaust valve for a cylinder 61 of an internal combustion engine. For example, the shaft 10 may be oriented above an engine cylinder 61 with the longitudinal axis 12 of the shaft orthogonal to the longitudinal axis of the engine cylinder 61, such as shown in FIG. 1. In some embodiments, the ends of the shaft 10 may be sealed.

The shaft 10 may comprise an outer wall 14. In some embodiments, the outer wall 14 may have a cylindrical shape. The shaft 10 may further comprise a first fluid passageway 16 and a second fluid passageway 26. The central axis of each fluid passageway 16, 26 may be oriented in a direction orthogonal to the longitudinal axis 12.

In some embodiments a shaft 10 may comprise a first or intake chamber 30 and a second or exhaust chamber 34. The chambers 30, 34 may be divided by a divider 32. A first intake aperture 40 and a second intake aperture 42 in the outer wall 14 may be in communication with the intake chamber 30. The first intake aperture 40 and the second intake aperture 42 may be located opposite one another across the longitudinal axis 12. The first fluid passageway 16 may comprise the first intake aperture 40, the intake chamber 30 and the second intake aperture 42. Similarly, a first exhaust aperture 44 and a second exhaust aperture 46 in the outer wall 14 may be in communication with the exhaust chamber 34. The first exhaust aperture 44 and the second exhaust aperture 46 may be located opposite one another across the longitudinal axis 12. The second fluid passageway 26 may comprise the first exhaust aperture 44, the exhaust chamber 34 and the second exhaust aperture 42. Further, dividers 32 may be used in the valve shaft 10 to adjust or reduce the size of the chambers 30, 34.

The length of each aperture 40, 42, 44, 46 in a direction parallel to the longitudinal axis 12 of the valve shaft 10 may be any suitable dimension, and may be limited by the size of a cylinder 61 which the valve shaft 10 provides intake air to and/or receives exhaust gasses from. Preferably, when the valve shaft 10 is properly placed with respect to the cylinder, the first fluid passageway 16 and the second fluid passageway 26 may be in communication with the cylinder during selected portions of valve shaft 10 rotation.

In some embodiments, a valve shaft 10 may comprise a solid shaft having at least one bore extending therethrough. A bore may extend in any direction and preferably may extend orthogonally to the longitudinal axis 12. A first bore may comprise a first fluid passageway 16. A second bore may comprise a second fluid passageway 26.

FIG. 3 shows an end view of an embodiment of a valve shaft 10 and relative angular placement of various intake/exhaust apertures 40, 42, 44, 46. The width of each aperture 40, 42, 44, 46 in a circumferential direction about the valve shaft 10 may be any suitable dimension and may be selected such that the aperture 40, 42, 44, 46 provides communication with a cylinder 61 when it is desirable for the valve to be open. Adjustment of the width of an aperture 40, 42, 44, 46 in a circumferential direction about the valve shaft 10 may adjust the timing provided to the engine.

A valve shaft 10 may rotate at any suitable speed. Rotation speed may be dependent upon the width of each aperture 40, 42, 44, 46. The valve shaft 10 may be driven by any suitable drive mechanism. In some embodiments, the valve shaft 10 may be driven by the crankshaft via a timing belt, timing chain or the like. In some embodiments, a valve shaft 10 may be rotated by a mechanism that is separate from the crankshaft. For example, a separate drive motor, such as an electric motor, may be arranged to rotate the valve shaft 10 independently of crankshaft positioning. A separate drive motor may be controlled by computer.

In one embodiment, the first intake aperture 40 may have a width measurement $\alpha$ of 22.5°. The second intake aperture 42 may also have a width measurement $\alpha$ of 22.5° and may be positioned across the longitudinal axis 12 of the valve shaft 10 from the first intake aperture 40. A first exhaust aperture 44 may have a width measurement $\alpha$ of 22.5°. The center of the first exhaust aperture 44 may be a rotational measurement $\theta$ of 135° from the center of the first intake aperture 40. The second exhaust aperture 46 may also have a width measurement $\alpha$ of 22.5° and may be positioned across the longitudinal axis 12 of the valve shaft 10 from the first exhaust aperture 44. A valve shaft 10 according to this embodiment may be arranged to rotate at one-quarter the speed of the crankshaft 68 (See FIG. 1).

Intake operation of an inventive valve assembly 8 will be discussed with reference to FIGS. 4-6, which show the intake portion of an embodiment of a valve shaft 10 arranged to provide air to a cylinder 61 during a piston 62 intake stroke. A first intake aperture 40 and a second intake aperture 42 are visible.

Figure 4:
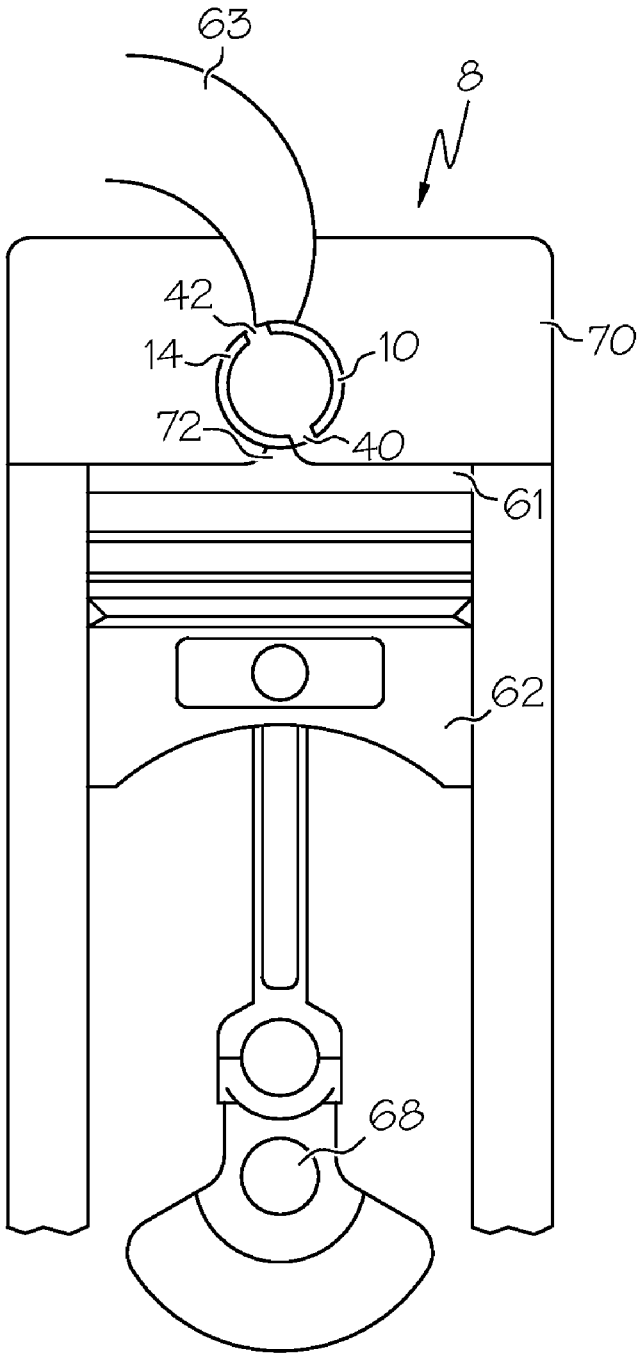
FIGS. 4-6 show a portion of an internal combustion engine and an embodiment of an inventive valve assembly throughout various portions of piston travel and valve operation.

FIG. 4 shows the piston 62 at a top dead center position at the beginning of an intake stroke. The intake valve 8 may be in a closed configuration, wherein the wall 14 of the valve shaft 10 blocks fluid flow through a lower head aperture 72 into the cylinder 61. The lower head aperture 72 may be any suitable size and may be the same size as either intake aperture 40, 42. The first intake aperture 40 may be adjacent to the lower head aperture 72, and the valve 8 may open upon rotation of the valve shaft 10. In some embodiments, the valve 8 may be slightly open when the piston 62 is at top dead center at the beginning of an intake stroke. As the crankshaft 68 turns and draws the piston 62 downward, the valve shaft 10 may rotate and open the valve 8.

Figure 5:
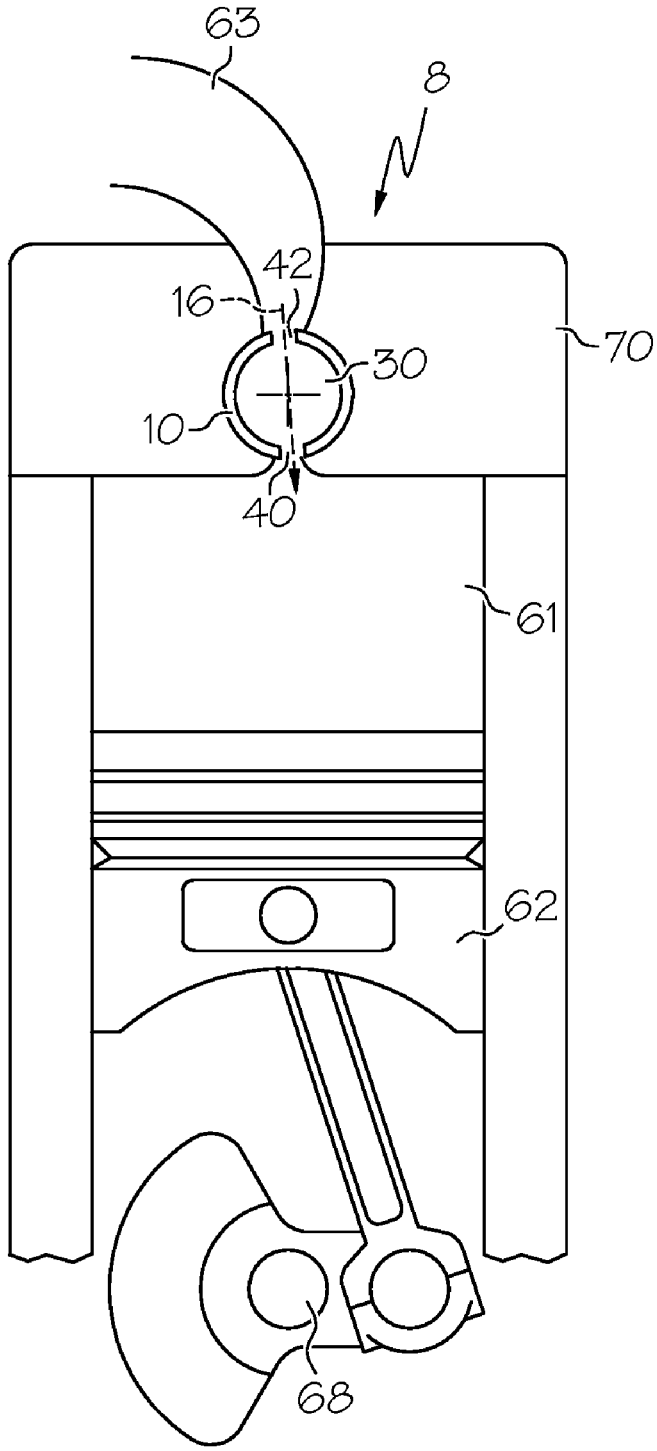

FIG. 5 shows the piston 62 partially through the intake stroke. The crankshaft 68 has rotated approximately 90° from its position in FIG. 4. The valve shaft 10 has rotated approximately 22.5°. The intake valve 8 may be fully open. The first fluid passageway 16 may allow fluid communication between the air intake 63 and the cylinder 61, and air may be drawn into the cylinder 61. It should be noted that when the piston 61 is at interim positions between the positions shown in FIGS. 4 and 5, the intake valve 8 may be partially open and will allow fluid flow into the cylinder 61.

Figure 6:
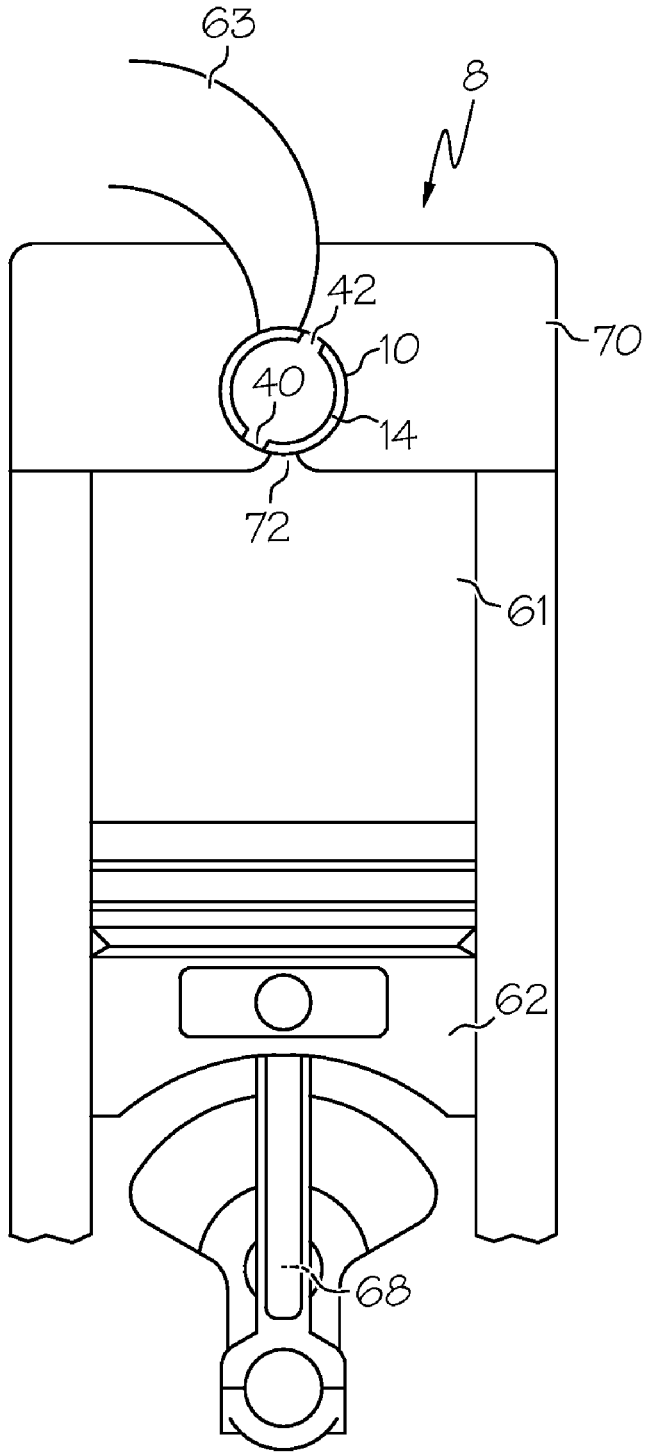

FIG. 6 shows the piston 61 at a bottom dead center position at the end of the intake stroke. The crankshaft 68 has rotated approximately 180° from its position in FIG. 4. The valve shaft 10 has rotated approximately 45°. The valve 8 has closed, and the wall 14 of the valve shaft 10 again blocks fluid flow through the lower head aperture 72 into the cylinder 61. The cylinder 61 is now sealed, and the intake valve 8 will remain closed during the successive compression, power (combustion) and exhaust strokes. The valve shaft 10 will continue to rotate during the successive strokes and will be in a position to reopen during the next intake stroke. In this embodiment, the valve 8 may open in an alternate configuration during the next intake stroke, wherein the second intake aperture 42 will be in proximity to the cylinder 61 and the first intake aperture 40 will be in proximity to the air intake 63.

Operation of an exhaust portion of a valve 8 may be similar to the operation described with respect to the intake and FIGS. 4-6, however, the exhaust portion of the valve will open during exhaust strokes. For this purpose, the exhaust fluid passageway 26 (See FIG. 2) is preferably rotationally staggered from the intake fluid passageway 16.

In various embodiments, the sizes of the fluid passageways 16, 26 may be adjusted to alter valve timing. For example, a larger intake fluid passageway 16 may be achieved by increasing the width of the apertures 40, 42 defining the intake fluid passageway 16. A larger intake fluid passageway 16 may allow the valve to open before the piston 62 reaches top dead center and/or remain open after the piston 62 reaches bottom dead center.

An inventive valve assembly 8 may be used with engines having any number of in-line cylinders. For example, a valve shaft 10 may be used on inline four and inline six cylinder engines. A valve shaft 10 may also be used on a bank of cylinders in engines having other configurations, such as flat or V configurations. For example, a valve shaft 10 may be used for a three cylinder bank which comprises one-half of a V-6 engine. A second valve shaft 10 may be used for the other bank of cylinders. Preferably, a valve shaft 10 includes an intake passageway and an exhaust passageway for each cylinder that the valve shaft 10 provides intake air to and receives exhaust gasses from. Intake passageways and exhaust passageways may alternate along the length of the valve shaft 10. In some embodiments, a valve shaft may include multiple intake passageways and/or exhaust passageways for each cylinder.

Figure 7:
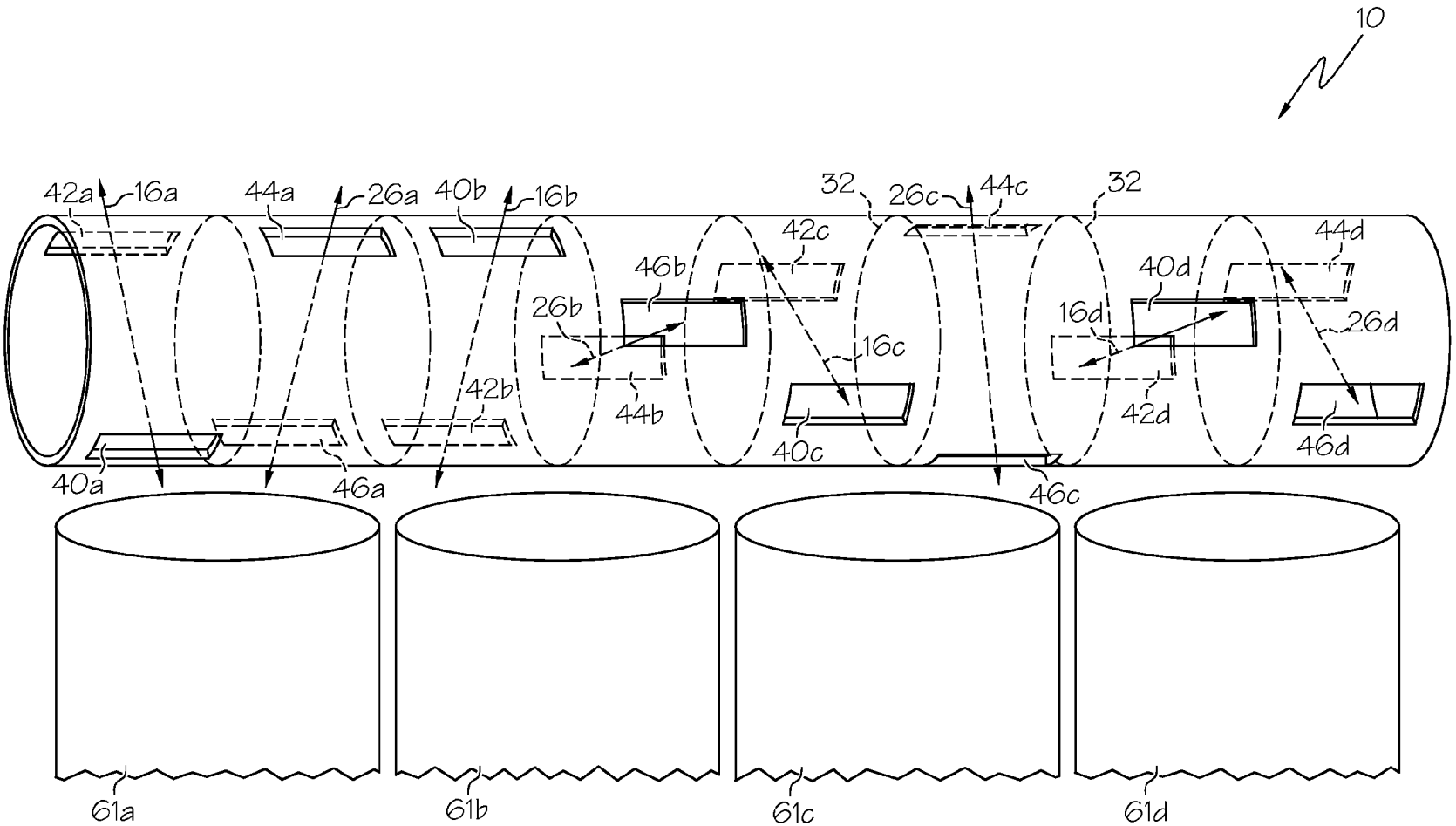
FIG. 7 shows a perspective view of another embodiment of an inventive valve assembly.

FIG. 7 shows another embodiment of a valve shaft 10, which may be arranged to provide intake and exhaust valving for four cylinders 61*a*-61*d*. The valve shaft 10 may include an intake passageway 16*a*-16*d* and an exhaust passageway 26*a*-26*d* for each cylinder 61*a*-61*d*. Each intake passageway 16*a*-16*d* may include a first intake aperture 40*a*-40*d* and a second intake aperture 42*a*-42*d*. Each exhaust passageway may include a first exhaust aperture 44*a*-44*d* and a second exhaust aperture 46*a*-46*d*. Adjacent intake passageways 16*a*-16*d* and exhaust passageways 26*a*-26*d* may be separated by a divider 32. The valve shaft 10 may be configured for a 1-3-4-2 engine firing order, wherein the firing sequence for the cylinders would be 61*a*-61*c*-61*d*-61*b*. The valve shaft 10 may rotate at ¼ the rotational speed of the crankshaft of the engine.

The valve shaft 10 is positioned such that the first cylinder 61*a* may begin an intake stroke with the first intake passageway 16*a* in communication with the first cylinder 61*a*, and the third cylinder 61*c* may begin an exhaust stroke with the third exhaust passageway 26*c* in communication with the third cylinder 61*c*. As these strokes are completed and the valve shaft 10 rotates, the third cylinder 61*c* will begin a subsequent intake stroke, and the rotation of the valve shaft 10 will have brought the third intake passageway 16*c* into communication with the third chamber 61*c*.

Figure 8:
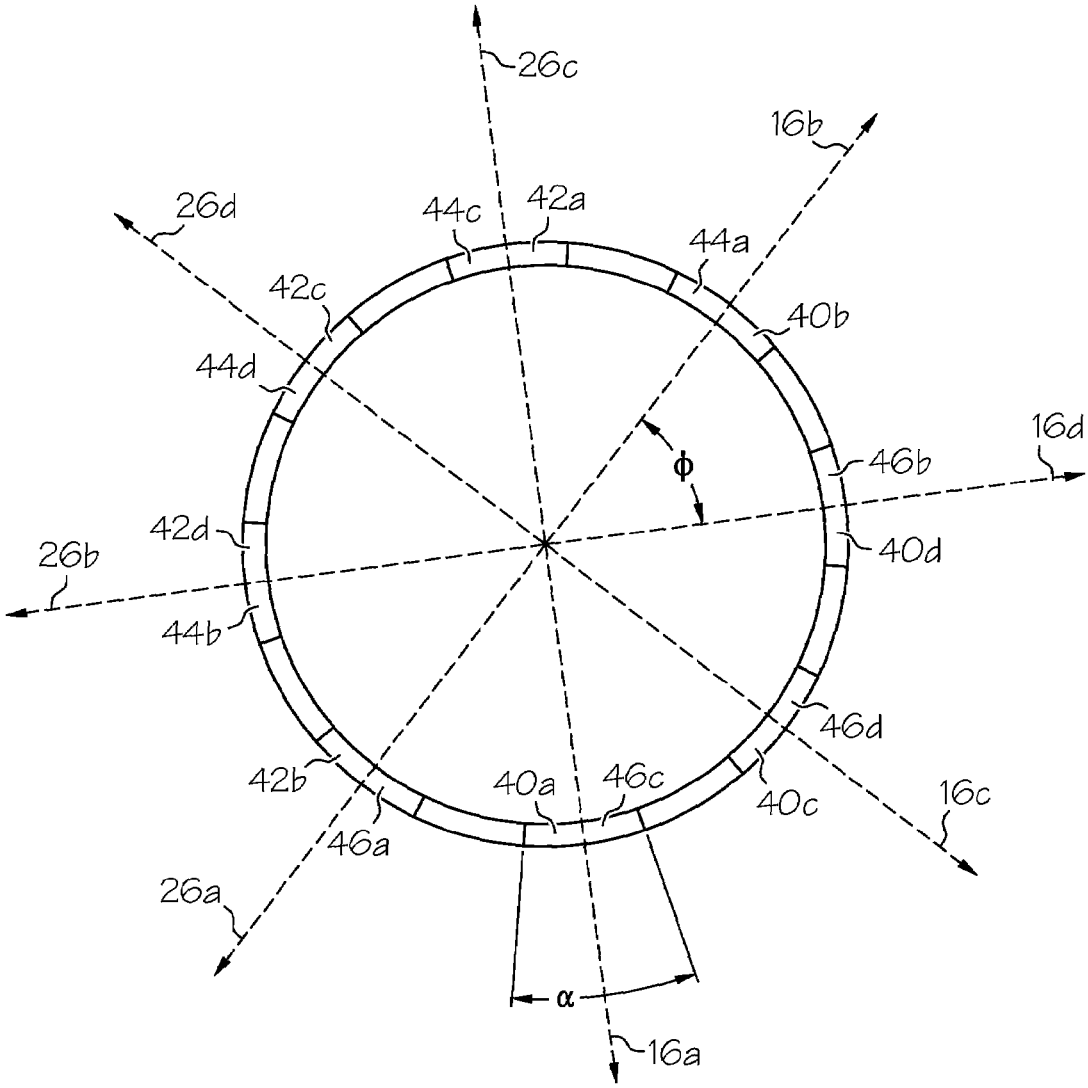
FIG. 8 is an end view of a rotatable shaft according to another embodiment of the invention.

FIG. 8 shows an end view of the valve shaft 10 of FIG. 7. The location and orientation of the intake passageways 16*a*-16*d* and exhaust passageways 26*a*-26*d* are shown. The locations of the various intake apertures 40, 42 and exhaust apertures 44, 46 are also shown. It can be seen that various intake passageways and exhaust passageways share a common plane. For example, an axis of intake passageway 16*a* for cylinder 61*a* lies in the same plane as an axis of exhaust passageway 26*c* for cylinder 61*c*. The angle $\phi$ between intake and exhaust axes may be 45°. The angle between an intake passageway 16 axis and an exhaust passageway 26 axis for a given cylinder 61 may be 135°. For example, the angle between intake passageway 16*a* and exhaust passageway 26*a* for cylinder 61*a* may be 135°. The width measurement $\alpha$ of each aperture 40, 42, 44, 46 in a circumferential direction about the valve shaft 10 may be 22.5°.

Figure 9:
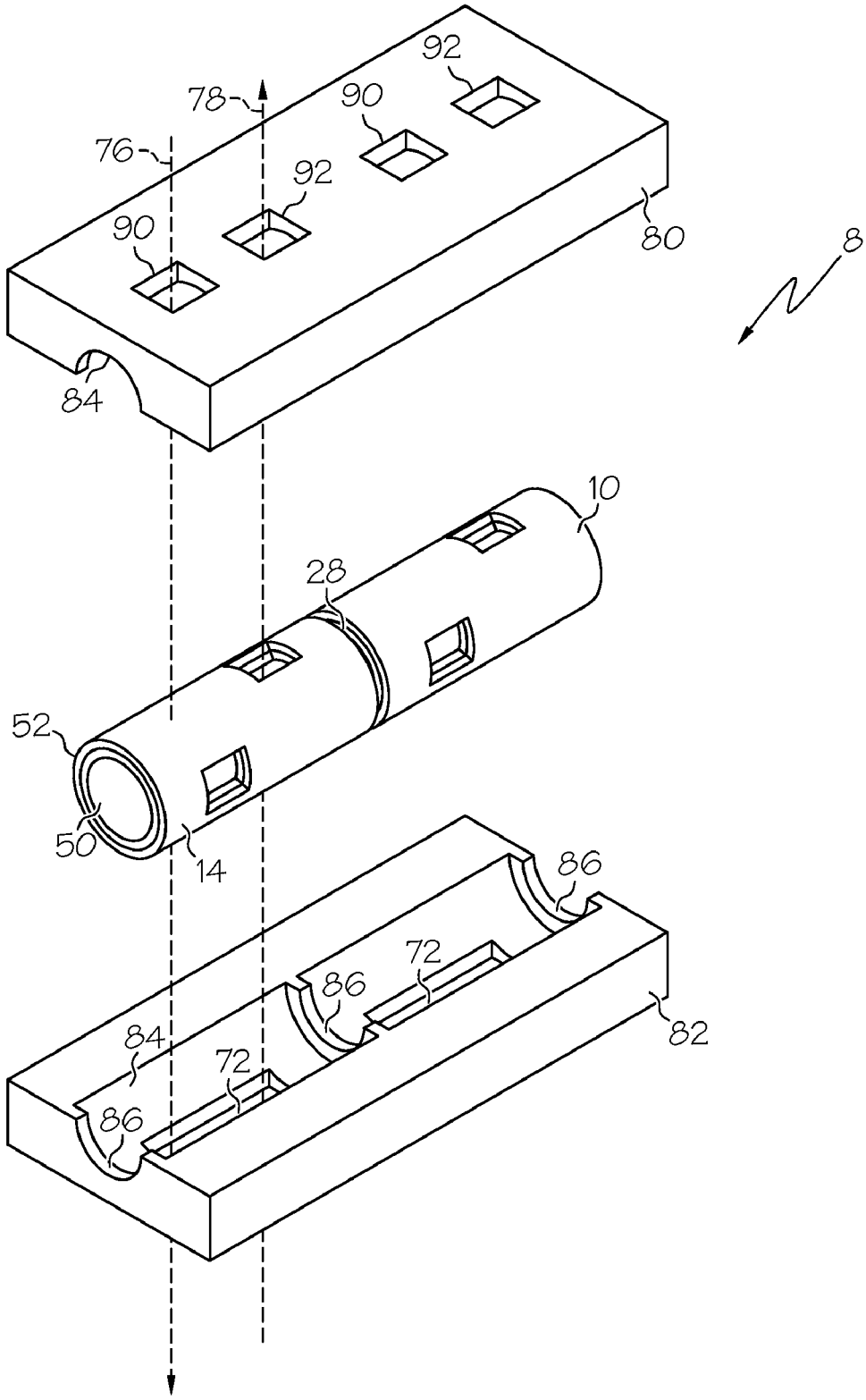
FIG. 9 shows a perspective view of another embodiment of an inventive valve shaft and an engine head.
Figure 11:
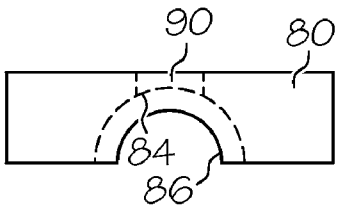
FIG. 11 shows an end view of an upper portion of an engine head.
Figure 10:
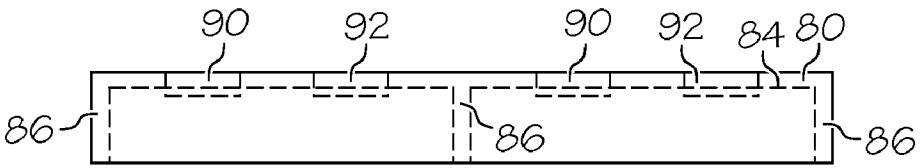
FIG. 10 shows a side view of an upper portion of an engine head.
Figure 12:
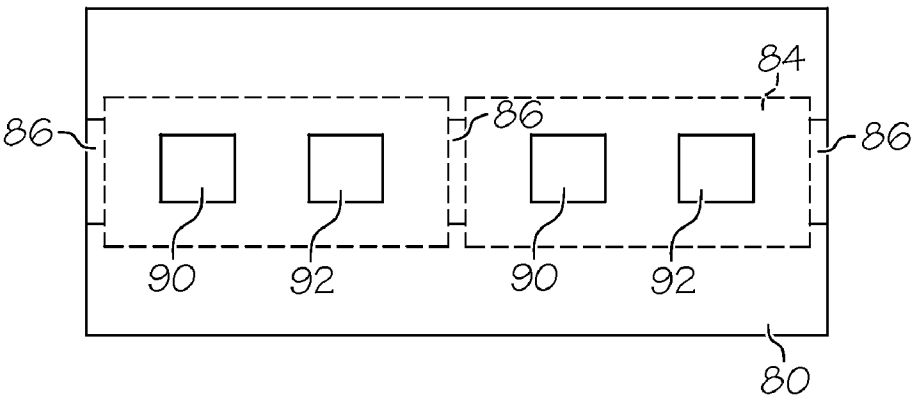
FIG. 12 shows a top view of an upper portion of an engine head.
Figure 14:
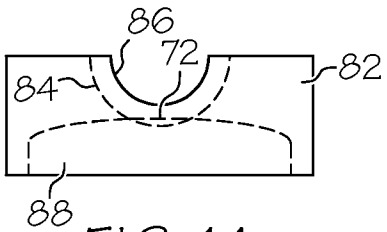
FIG. 14 shows an end view of a lower portion of an engine head.
Figure 13:
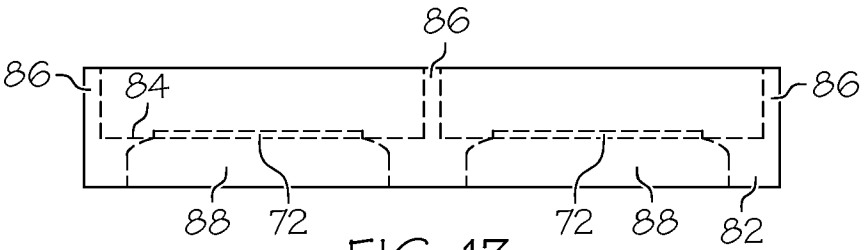
FIG. 13 shows a side view of a lower portion of an engine head.
Figure 15:
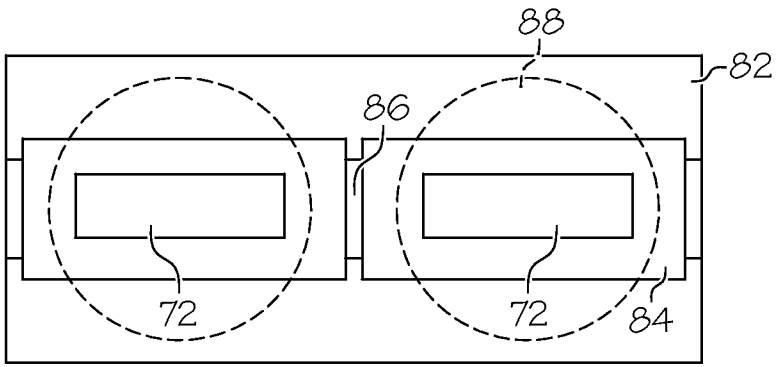
FIG. 15 shows a top view of a lower portion of an engine head.

FIG. 9 shows another embodiment of an intake and/or exhaust valve assembly 8. The valve shaft 10 may comprise an inner valve shaft 50 and an outer valve shaft 52. Each valve shaft 50, 52 may have at least one fluid passageway extending therethrough. The inner valve 50 shaft may be arranged to rotate at a different speed than the outer valve shaft 52. Thus, the valve may be open when the fluid passageway of the inner valve shaft 50 and the fluid passageway of the outer valve shaft 52 are both oriented to allow fluid communication with the cylinder, and the valve may be closed if either valve shaft 50, 52 is oriented such that the wall of the shaft block fluid communication with the cylinder, as described in greater detail below. The valve shaft 10 may be installed in the engine head 70, which may comprise an upper head portion 80 and a lower head portion 82.

FIGS. 10-15 show additional views of embodiments of an upper head portion 80 and a lower head portion 82. Each head portion 80, 82 may include a shaped interior surface portion 84 which is shaped to receive the valve shaft 10. The valve shaft 10 may be sandwiched within and supported by the header 70.

Each head portion 80, 82 may also include at least one mating portion 86, such as a flange, which may be arranged to mate with a mating portion 28 on the valve shaft 10, such as a groove. Interaction between the mating portion(s) 86 of the head 70 and the mating portion(s) 28 of the valve shaft 10 may allow the valve shaft 10 to rotate but may prevent lateral translocation of the valve shaft 10 with respect to the head 70. In some embodiments, a mating portion 86 of the head 70 may abut an end of the valve shaft 10. In some embodiments, a mating portion 86 of the head 70 may comprise a groove, and a mating portion 28 of the valve shaft 10 may comprise a raised flange. In some embodiments, a mating portion 86 of the head 70 may comprise a groove, a mating portion 28 of the valve shaft 10 may comprise a groove, and a locking ring (not shown) may be positioned to extend into both grooves.

For each cylinder, the head 70 may define an intake flow path 76 and an exhaust flow path 78 (see FIG. 9). The flow paths 76, 78 may be opened and closed by the valve shaft 10 according to the rotational orientation of the inner valve shaft 50 and outer valve shaft 52.

The upper head portion 80 desirably includes an intake aperture 90 for each intake flow path 76 and an exhaust aperture 92 for each exhaust flow path 78. Each intake aperture 90 may be in communication with an air intake system and each exhaust aperture 92 may be in communication with an exhaust system.

The lower head portion 82 may include a lower head aperture 72 for each cylinder. Portions of a lower head aperture 72 may provide a flow path for both the intake and exhaust gasses. In some embodiments, a first lower head aperture may be provided for the intake gasses and a second lower head aperture may be provided for exhaust gasses. The lower head portion 82 may also include a plenum space 88 (see FIGS. 13-15) for each cylinder which may be in communication with the cylinder. A plenum space 88 may comprise a cylindrical bore and may have a pent roof. The diameter of the plenum space 88 is desirably the same as the diameter of the cylinder. The plenum space 88 may comprise a portion of an engine cylinder.

The valve shaft 10 may be rotatably supported by the upper head portion 80 and the lower head portion 82. The shaft wall 14 may bear against interior portions of the upper head portion 80 and the lower head portion 82.

Figure 16:
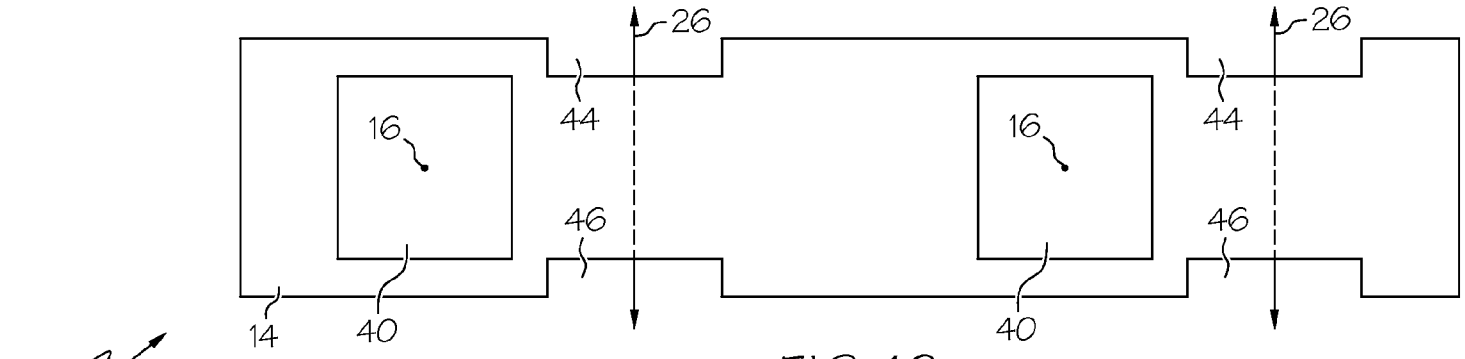
FIG. 16 shows a side view of an embodiment of an inner rotatable shaft according to an embodiment of the invention.
Figure 17:
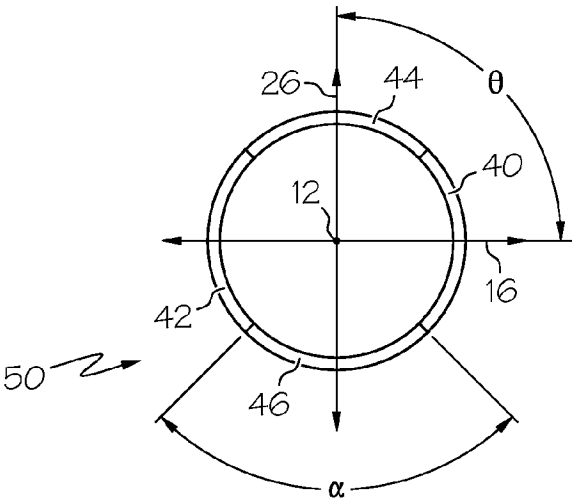
FIG. 17 shows an end view of an inner rotatable shaft according to an embodiment of the invention.

FIGS. 16 and 17 show an embodiment of an inner shaft 50, which may be substantially cylindrical. For each cylinder, the inner shaft 50 may include a first or intake fluid passageway 16 and a second or exhaust fluid passageway 26. A first intake aperture 40 and a second intake aperture 42 through the shaft wall 14 may provide for the intake fluid passageway 16. A first exhaust aperture 44 and a second exhaust aperture 46 through the shaft wall 14 may provide for the exhaust fluid passageway 26.

The first intake aperture 40, second intake aperture 42, first exhaust aperture 44 and second exhaust aperture 46 may all be any suitable size. The length of each aperture 40, 42, 44, 46 in a direction parallel to a longitudinal axis of the inner shaft 50 may be any suitable dimension, and may be limited by the size of a cylinder which the valve shaft 10 provides intake air to and receives exhaust gasses from. Preferably, when the valve shaft 10 is properly placed with respect to the cylinder, the first fluid passageway 16 and the second fluid passageway 26 may be in communication with the cylinder during selected portions of valve shaft 10 rotation.

In one embodiment, the first intake aperture 40 may have a width measurement $\alpha$ of 90° about the circumference of the inner shaft 50. The second intake aperture 42 may also have a width measurement $\alpha$ of 90° and may be positioned across the longitudinal axis 12 of the inner shaft 50 from the first intake aperture 40. A first exhaust aperture 44 may have a width measurement α of 90°. The center of the first exhaust aperture 44 may be a rotational measurement θ of 90° from the center of the first intake aperture 40. The second exhaust aperture 46 may also have a width measurement α of 90° and may be positioned across the longitudinal axis 12 from the first exhaust aperture 44. An inner shaft 50 according to this embodiment may work in conjunction with an outer shaft 52 to provide an engine with proper valve timing.

Figure 18:
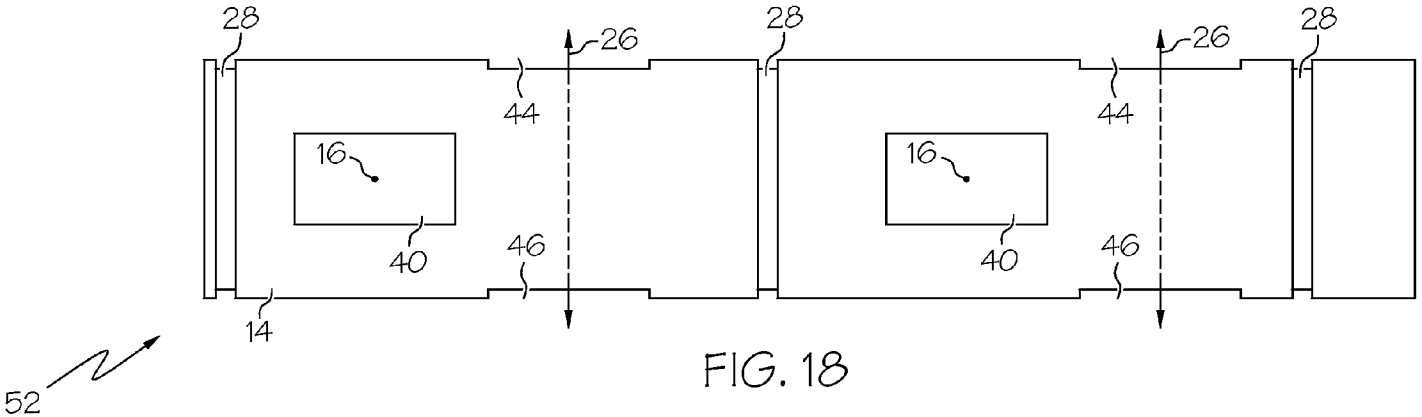
FIG. 18 shows a side view of an embodiment of an outer rotatable shaft according to an embodiment of the invention.
Figure 19:
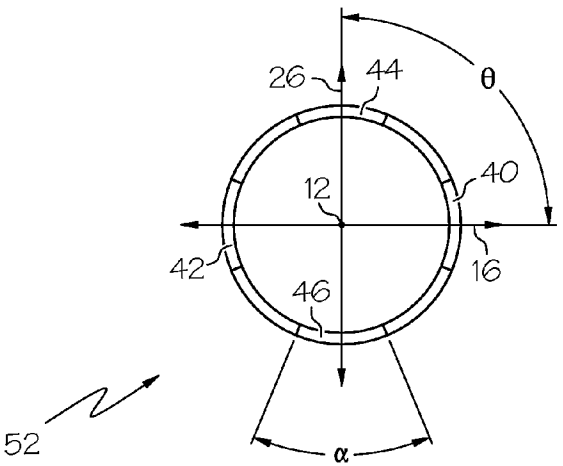
FIG. 19 shows an end view of an outer rotatable shaft according to an embodiment of the invention.

FIGS. 18 and 19 show an embodiment of an outer shaft 52, which may be substantially cylindrical. For each cylinder, the outer shaft 52 may include a first or intake fluid passageway 16 and a second or exhaust fluid passageway 26. A first intake aperture 40 and a second intake aperture 42 through the shaft wall 14 may provide for the intake fluid passageway 16. A first exhaust aperture 44 and a second exhaust aperture 46 through the shaft wall 14 may provide for the exhaust fluid passageway 26.

The first intake aperture 40, second intake aperture 42, first exhaust aperture 44 and second exhaust aperture 46 of the outer shaft 52 may all be any suitable size. The length of each aperture 40, 42, 44, 46 in a direction parallel to a longitudinal axis of the outer shaft 52 may be any suitable dimension, and may be limited by the size of a cylinder which the valve shaft 10 provides intake air to and receives exhaust gasses from. Preferably, when the valve shaft 10 is properly placed with respect to the cylinder, the first fluid passageway 16 and the second fluid passageway 26 may be in communication with the cylinder during selected portions of valve shaft 10 rotation.

In one embodiment, the first intake aperture 40 may have a width measurement α of 45° about the circumference of the outer shaft 52. The second intake aperture 42 may also have a width measurement α of 45° and may be positioned across the longitudinal axis 12 of the inner shaft 50 from the first intake aperture 40. A first exhaust aperture 44 may have a width measurement α of 45°. The center of the first exhaust aperture 44 may be a rotational measurement θ of 90° from the center of the first intake aperture 40. The second exhaust aperture 46 may also have a width measurement α of 45° and may be positioned across the longitudinal axis 12 from the first exhaust aperture 44. An outer shaft 52 according to this embodiment may work in conjunction with an inner shaft 50 to provide an engine with proper valve timing.

Figure 20:
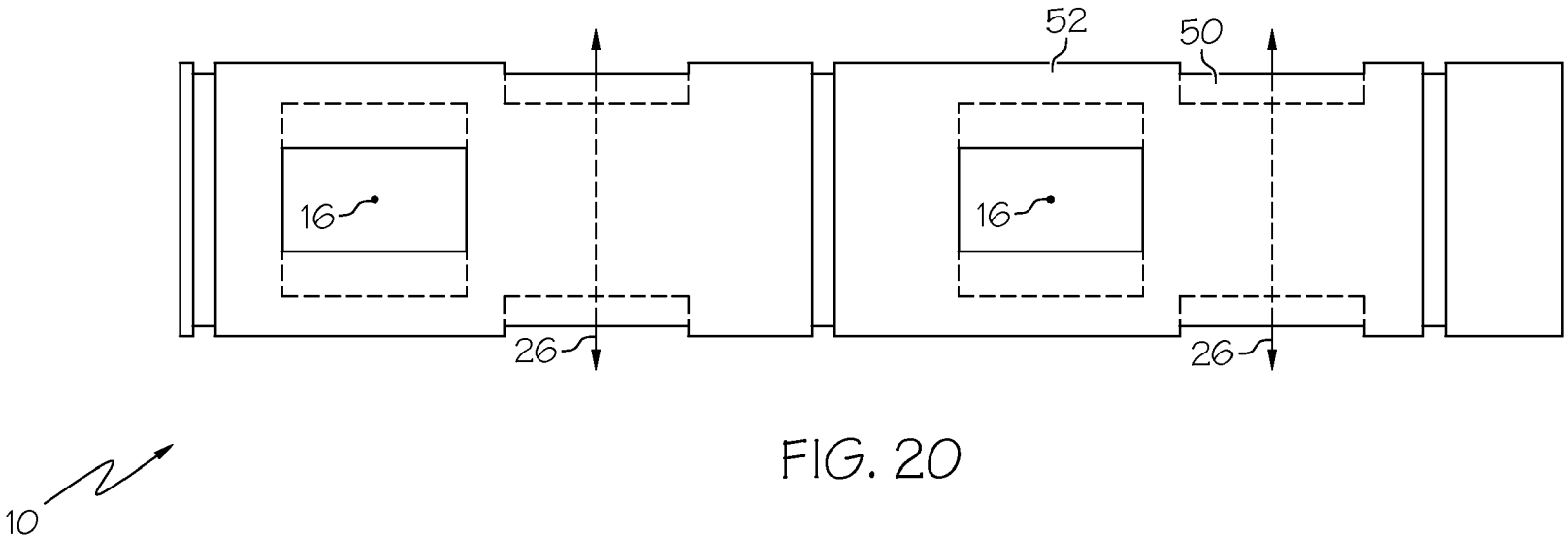
FIG. 20 shows a view of an inventive rotatable shaft assembly including an inner shaft and an outer shaft.

FIG. 20 shows an embodiment of a valve shaft 10 comprising an inner shaft 50 and an outer shaft 52. The inner shaft 50 and the outer shaft 52 may be arranged to rotate at different speeds. Communication between a cylinder and an intake or exhaust system may be allowed when the corresponding fluid passageways of the inner shaft 50 and the outer shaft 52 are both positioned to allow fluid communication. If a shaft wall 14 of either shaft 50, 52 is oriented to block fluid communication, the valve may be considered closed.

In one embodiment, the inner shaft 50 may be arranged to rotate at ¼ the speed as the engine crankshaft, and the outer shaft may be arranged to rotate at ½ the speed as the engine crankshaft. Both the inner shaft 50 and the outer shaft 52 may be driven by the crankshaft, such as by timing belt or chain and incorporating proper reduction gearing.

In some embodiments, the inner shaft 50 and the outer shaft 52 may each be rotated by a drive motor that is separate from the crankshaft. For example, an electric motor may be arranged to rotate the inner shaft 50, and another electric motor may be arranged to rotate the outer shaft 52. When a separate drive motor or mechanism is used, the valve shaft 10 may be operated independently of the crankshaft. A separate drive motor may be controlled by computer.

FIGS. 21-27 show the operation of an intake portion of an embodiment of a valve shaft 10 comprising an inner shaft 50 and an outer shaft 52.

Figure 21:
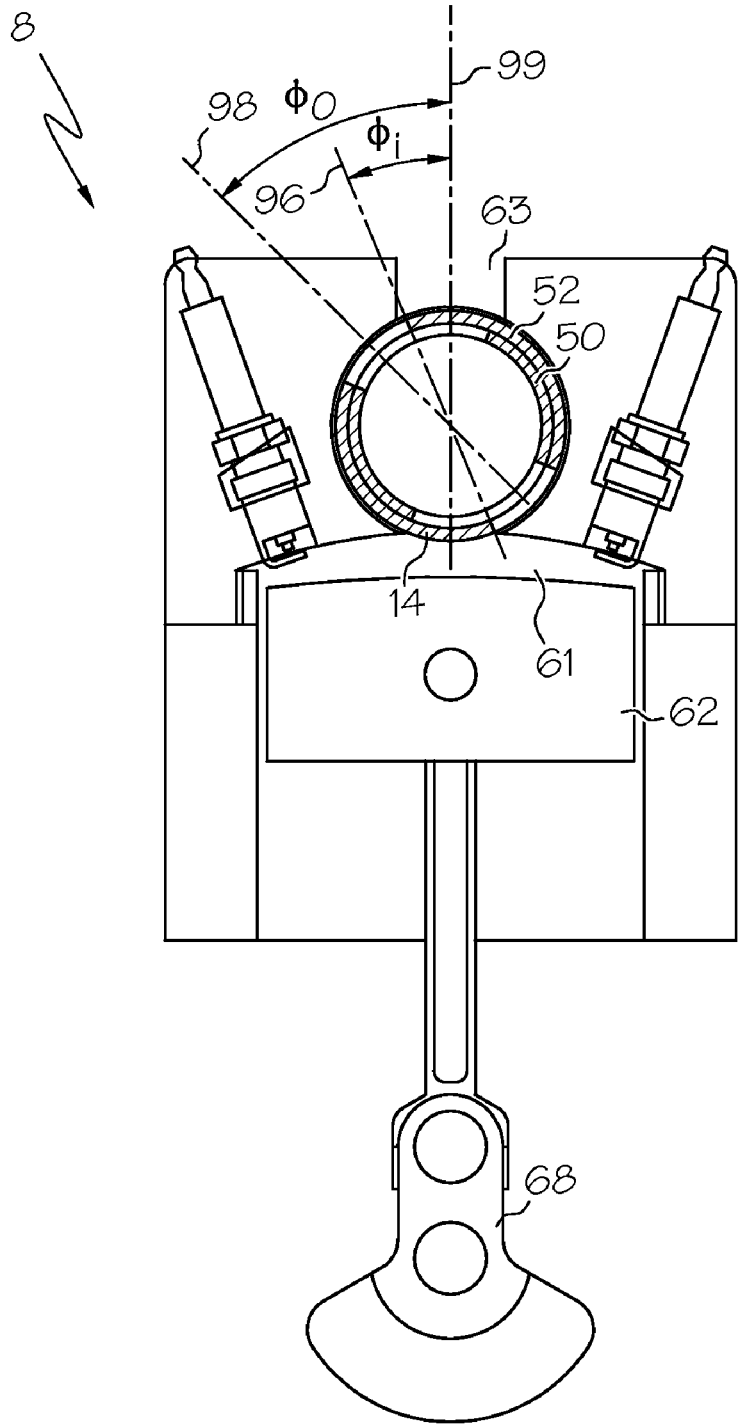
FIGS. 21-27 show portions of an internal combustion engine and an embodiment of an inventive valve assembly during various stages of engine operation.

FIG. 21 shows a piston 62 located at top dead center. The valve assembly 8 is closed, as the shaft wall 14 of the outer shaft 52 blocks fluid flow from the air intake 63 to the cylinder 61. A reference line 96 has been provided to show angular location of the center of an intake aperture of the inner shaft 50. This reference line 96 also represents a central longitudinal axis of the intake passageway through the inner shaft 50. A similar reference line 98 shows the center of an intake aperture of the outer shaft 52, and a central longitudinal axis of the intake passageway through the outer shaft 52.

The central axis 98 of the intake passageway of the outer shaft 52 may be oriented at an angular measurement $\phi_o$ of approximately 45° from a reference vertical 99. The central axis 96 of the intake passageway of the inner shaft 50 may be oriented at an angular measurement $\phi_i$ of approximately 22.5° from a reference vertical 99.

Desirably, the outer shaft 52 may be positioned such that any rotational advancement will begin to open the valve assembly 8.

As the piston 62 begins an intake stroke and the crankshaft 68 rotates, the inner shaft 50 and outer shaft 52 rotate. Rotation of the outer shaft 52 allows the fluid passageways of both the inner shaft 50 and the outer shaft 52 to become positioned to allow fluid communication between the air intake 63 and the cylinder 61, and air is able to flow into the cylinder 61.

Figure 22:
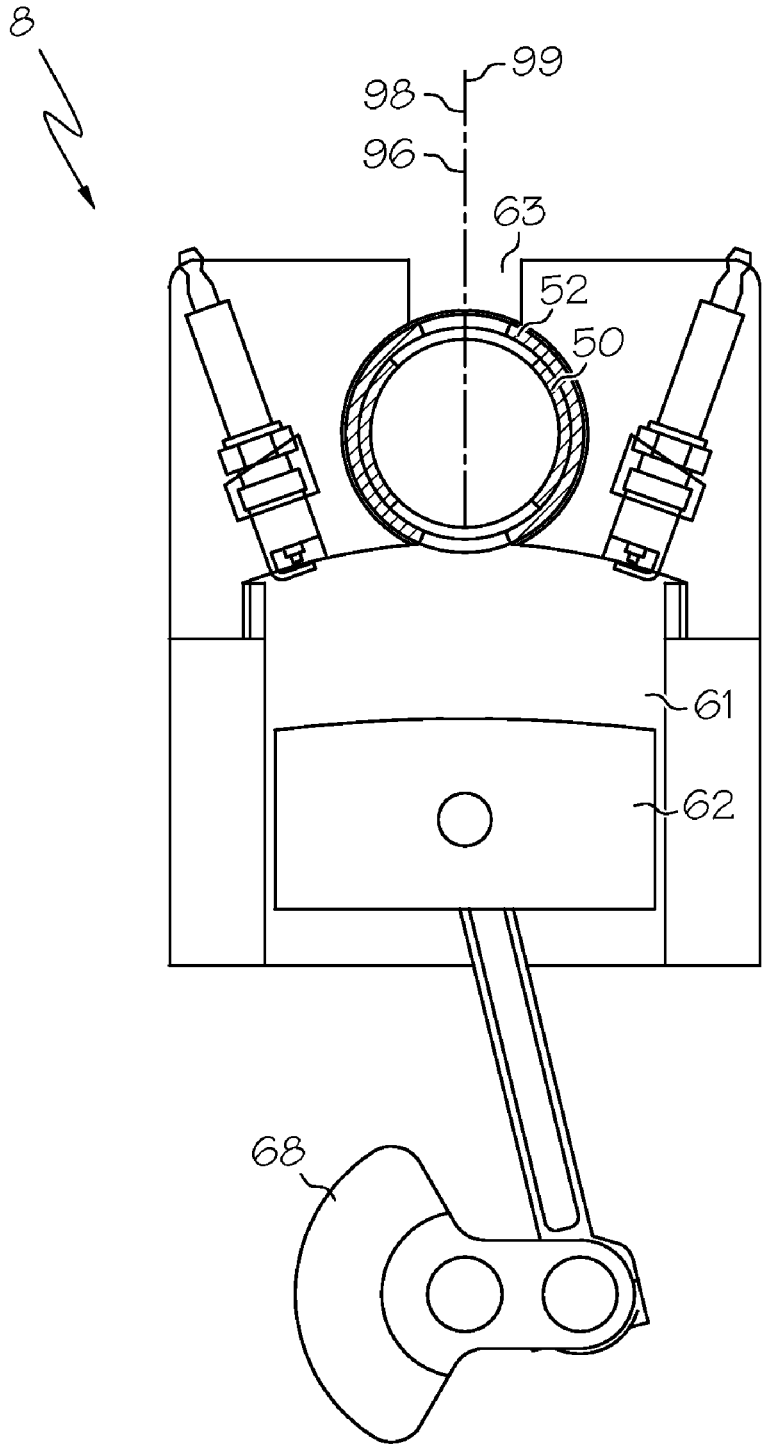

FIG. 22 shows the piston 62 partially through an intake stroke. The crankshaft 68 has rotated approximately 90° from its position in FIG. 21. The outer shaft 52 has rotated approximately 45°, and the inner shaft has rotated approximately 22.5°. The reference line 98 for the outer shaft 52 and the reference line for 96 for the inner shaft 50 may correspond with the reference vertical 99. The intake passageways for the outer tube 52 and the inner tube 50 are aligned. The valve assembly 8 may be fully open, as the longitudinal axes of the inner shaft 50 and the outer shaft 52 are aligned and centered with the lower head aperture 72 and the air intake 63.

Figure 23:
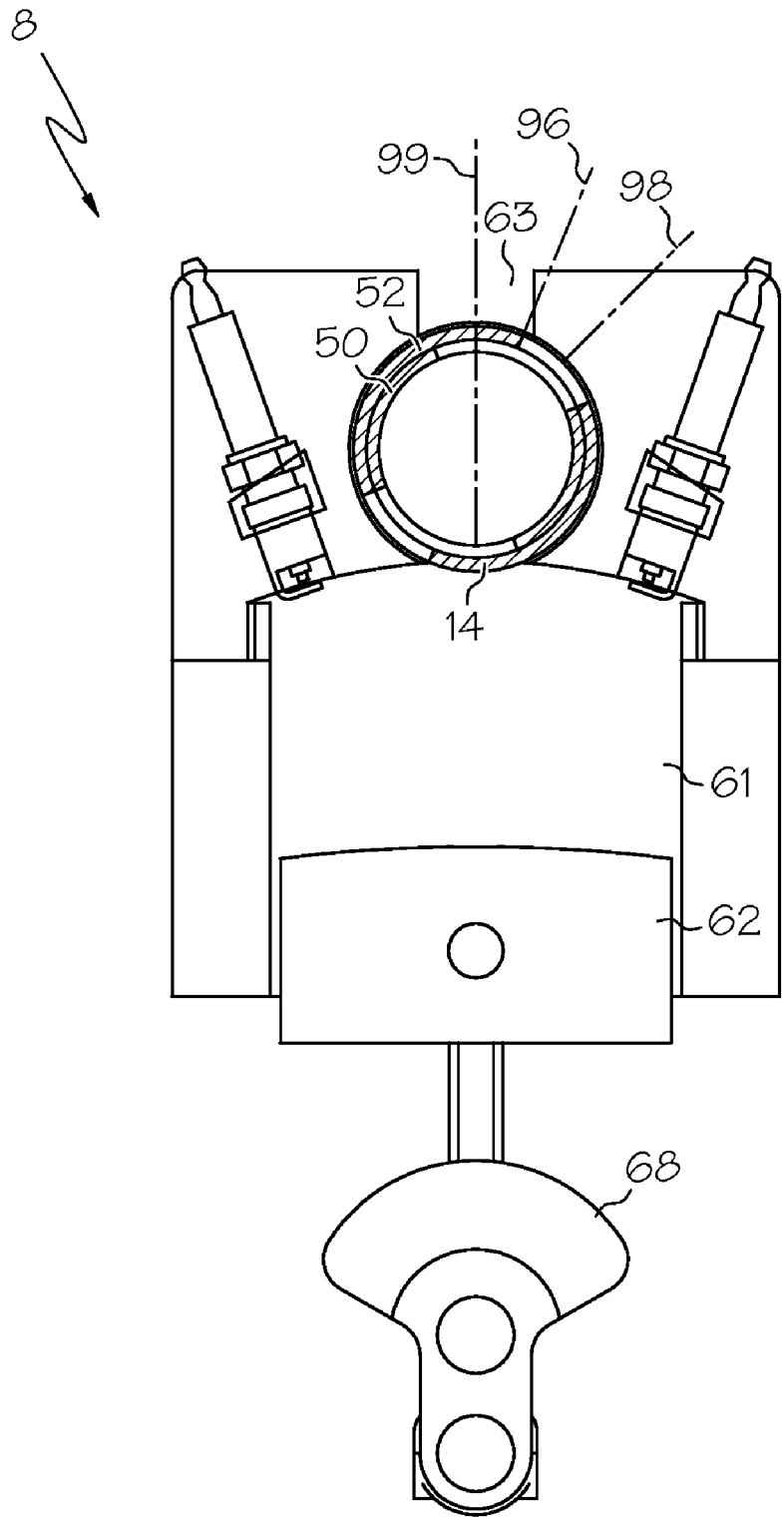

FIG. 23 shows the piston 62 at bottom dead center. The intake stroke is completed. The crankshaft has rotated approximately 90° from its position in FIG. 22. The outer shaft 52 has rotated another 45° and the inner shaft 50 has rotated another 22.5°. The valve assembly 8 is now closed, as a wall portion 14 of the outer tube 52 blocks fluid flow between the air intake 63 and the cylinder 61.

Due to the continual rotation of the inner shaft 50 and the outer shaft 52 under engine operation, it should be understood that the valve assembly 8 is open during substantially the entire intake stroke.

The piston 62 may now begin upward travel and the compression stroke.

Figure 24:
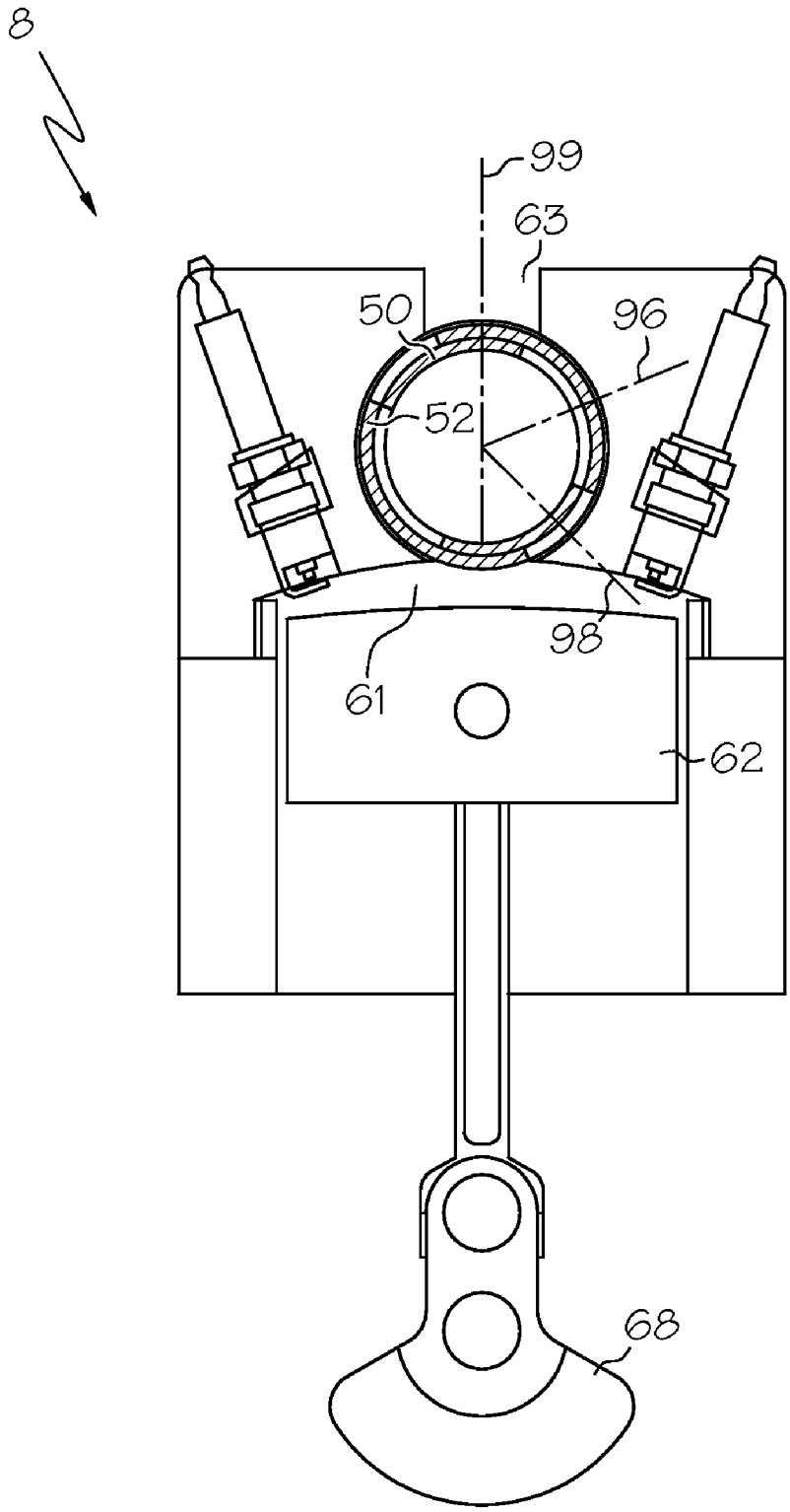

FIG. 24 shows the piston 61 at top dead center after a compression stroke. The crankshaft 68 has rotated 180° from its position in FIG. 23, and 360° from its position in FIG. 21. The outer shaft 52 has rotated approximately 90° from its position in FIG. 23 and approximately 180° from its position in FIG. 21 (see reference line 98). The inner shaft 50 has rotated approximately 45° from its position in FIG. 23 and approximately 90° from its position in FIG. 21 (see reference line 96). The valve assembly 8 is closed, as a wall 14 of both the inner shaft 50 and the outer shaft 52 are positioned to prevent fluid communication between the air intake 63 and the cylinder 61.

Figure 25:
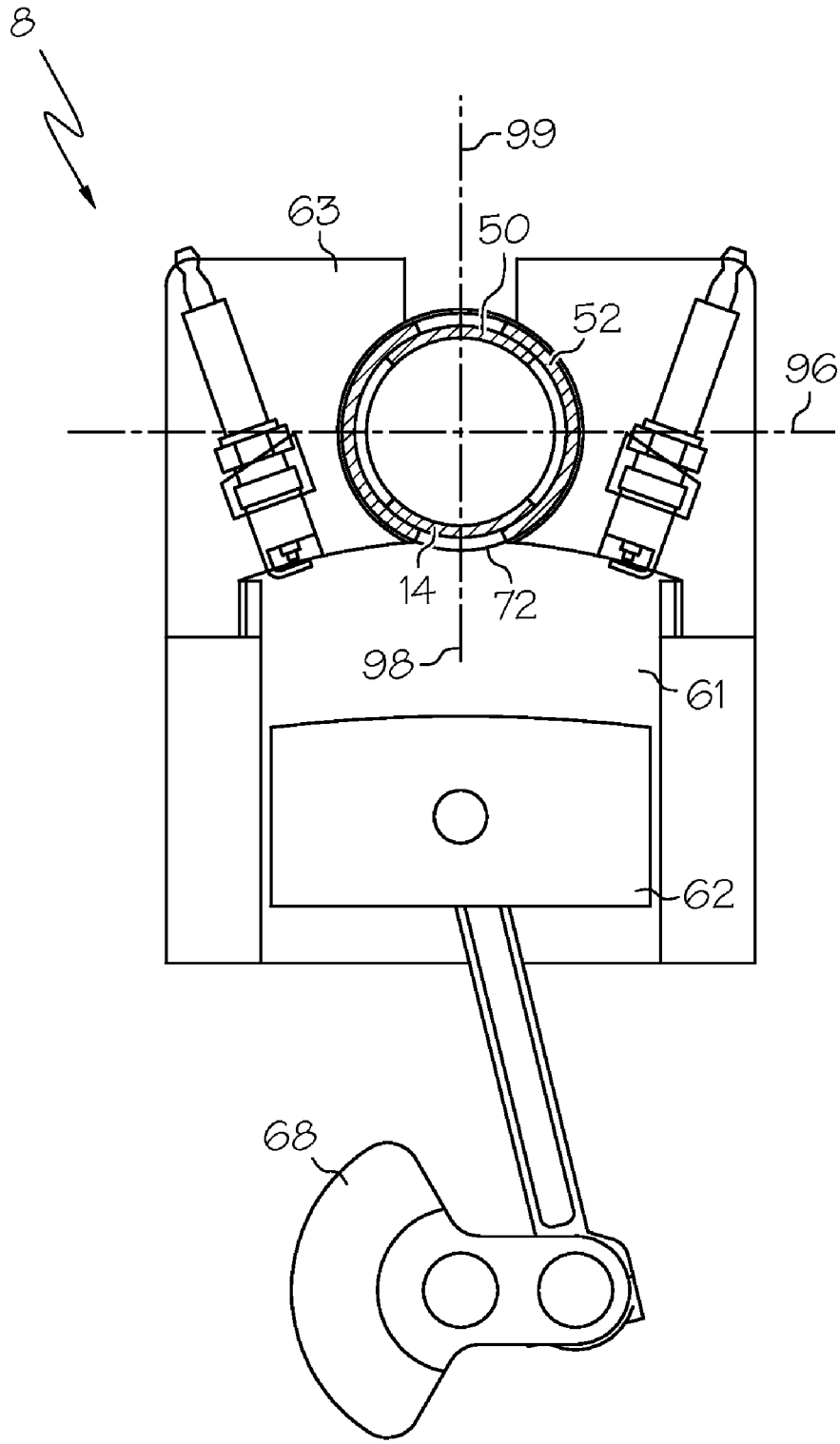

FIG. 25 shows the piston 62 partially through the power stroke. The valve assembly 8 remains closed as the shaft wall 14 of the inner shaft 50 blocks fluid communication between the air intake 63 and the cylinder 61, even as an intake aperture 40 sweeps past the lower head aperture 72.

Figure 26:
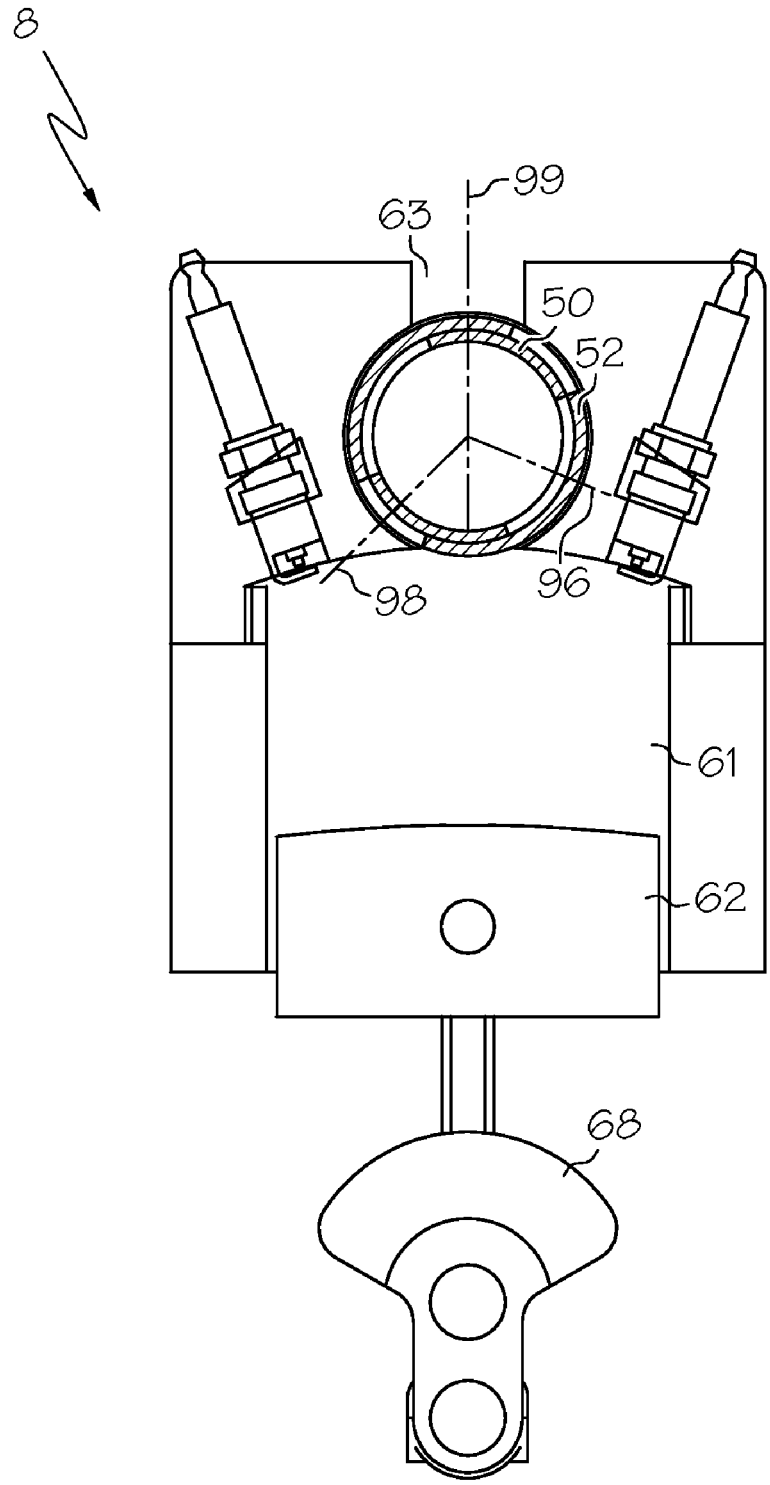

FIG. 26 shows the piston 62 at bottom dead center at the end of the power stroke, at the beginning of the exhaust stroke. Desirably, an exhaust portion of the valve assembly 8 will be arranged to open during the exhaust stroke. The intake portion of the valve assembly 8 remains closed.

Figure 27:
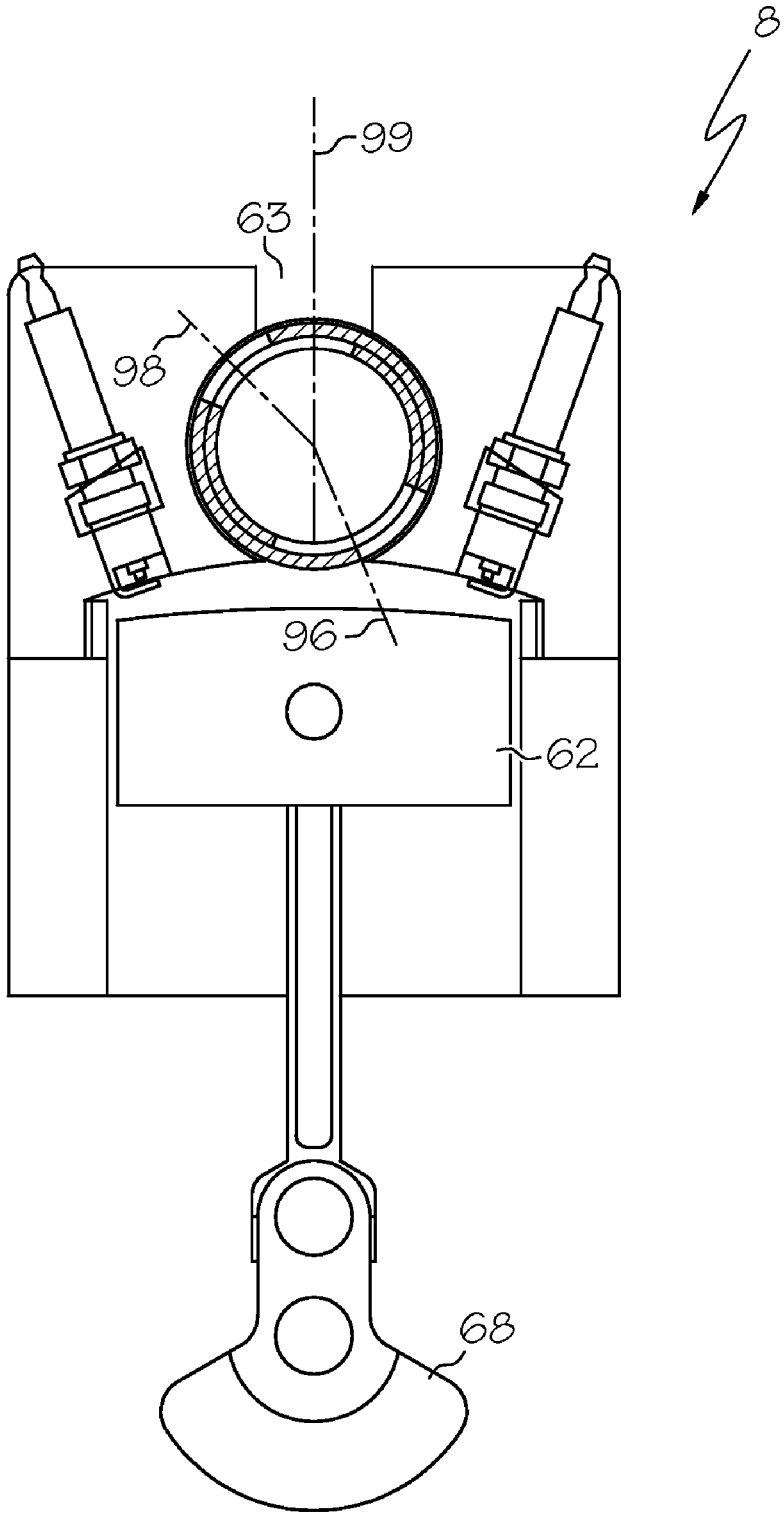

FIG. 27 shows the piston 62 at top dead center at the end of an exhaust stroke and at the beginning of another intake stroke. Positioning of the crankshaft 68 and the piston 62 correspond with FIG. 21. The outer shaft 52 has completed one complete revolution, and its positioning corresponds with FIG. 21. The inner shaft 50 has rotated a total of 180° from its position in FIG. 21. Although the inner shaft 50 rotates at half the speed of the outer shaft 52, the valve assembly 8 is again arranged to begin allowing fluid communication between the air intake 63 and the cylinder 61, similar to FIG. 21, and the intake stroke may begin.

After another engine cycle of intake, compression, power and exhaust strokes, the inner shaft 50 will have rotated another 180°, the outer shaft 52 will have rotated another 360°, and positioning of the valve assembly 8, piston 62 and crankshaft 68 will all correspond with FIG. 21.

An exhaust portion of a valve assembly 8 may be arranged to operate similarly to the intake operation as described with respect to FIGS. 21-27, allowing fluid communication between the cylinder and an exhaust system during the exhaust strokes.

When a valve shaft 10 comprises an inner shaft 50 and an outer shaft 52, the shafts 50, 52 may both rotate in the same direction, or the shafts 50, 52 may rotate in opposite directions. Rotation in opposite directions may provide a net reduction in external torque and/or angular momentum generated by the rotating shafts 50, 52.

In various embodiments, the circumferential width of the apertures 40, 42, 44, 46 in the inner shaft 50 and outer shaft 52 may be increased or decreased to adjust engine timing. The size of the intake apertures 90 and exhaust apertures 92 in the upper head portion 80, and the size of the lower head aperture(s) 72 in the lower head portion 82 may also be increased or decreased accordingly. Rotational speed of the inner shaft 50 and outer shaft 52 may be adjusted to provide proper engine timing given the size of the apertures 40, 42, 44, 46 of the respective valve shafts 50, 52.

In some embodiments, the intake may have a 210° cycle, wherein the valve may open 20° before a piston reaches top dead center, and may remain open until 10° after bottom dead center. The circumferential width of the apertures 40, 42 of the inner shaft 50 may be 105°. The circumferential width of the apertures 44, 46 of the outer shaft 52 may be 52.5°.

In various embodiments of the invention, any suitable engine timing cycle may be used, such as any timing between 180° and 210°, less than 180° or more than 210°. Generally, a shorter timing cycle may be desirable at lower engine speeds and applications. Valves may open at any desirable time before or after top dead center and may close at any desirable time before or after bottom dead center. Exhaust valve portions may be configured to operate similarly to the intake portions as described above.

Figure 28:
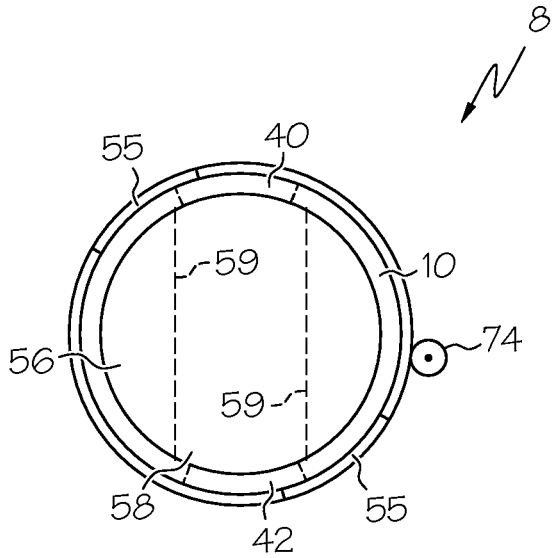
FIG. 28 shows another embodiment of an inventive valve.

Referring to FIG. 28, in some embodiments, the valve assembly 8 may further comprise a rotatable switch shaft 54. A switch shaft 54 may comprise a tube having apertures 55 and defining a fluid passageway therebetween. Apertures 55 may be of any desirable dimensions. A switch shaft 54 may be oriented about a valve shaft 10 and may rotate independently of the valve shaft 10. For example, a switch shaft 54 may be rotated by a motor 74.

A switch shaft 54 may function as a separately controllable closing switch for a valve. A switch shaft 54 may be used to close the valve regardless of the orientation of the valve shaft 10. A switch shaft 54 may allow a valve to be open when the apertures 55 are aligned with flow path openings for the valve, such as an upper head intake aperture 90 and a lower head aperture 72 (see FIG. 9). The switch shaft 54 may close the valve when a wall portion of the switch shaft 54 prevents fluid flow into or out of a cylinder.

A switch shaft 54 may be arranged to rotate continuously in a single direction, consecutively allowing for the valve to be open and closing the valve, or may be arranged to rotate back and forth in opposite directions with any desirable amount of rotational travel.

Any embodiment described herein may include a switch shaft 54.

In some embodiments, a switch shaft 54 may be located within the valve shaft 10, or may even be sandwiched between an inner shaft and an outer shaft in a multiple shaft valve shaft 10.

Any embodiment of the valve assembly 8 described herein may further comprise a flow path member 56, which may be located within the valve shaft 10. A flow path member 56 may be a stationary member having a fixed flow pathway 58. A flow path member 56 may span the length of the valve shaft 10 and may include a separate flow pathway 58 for each intake and exhaust valve portion. The flow pathway 58 may allow for less turbulent flow through the valve than would be achieved in the absence of a flow path member 56, as the flow path through the valve shaft 10 is defined by stationary walls 59. A flow pathway 58 may have any suitable dimensions.

Figure 29:
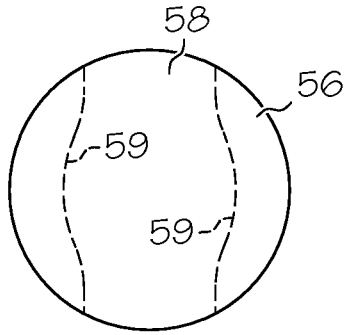
FIG. 29 shows an embodiment of a flow path member.

FIG. 29 shows another embodiment of a flow path member 56, wherein the flow pathway 56 may include contoured walls 59 having curvature. Contoured walls 59 may further reduce turbulence within the flow path member 56.

In some embodiments, the circumferential width of the apertures 40, 42, 44, 46 or the circumferential location of the apertures 40, 42, 44, 46 may be adjusted to allow the intake and exhaust valves to be open or closed at different times, thus altering timing of the engine. For example, the size or positioning may be modified to allow both an intake valve and an exhaust valve of a common cylinder to be open simultaneously for a desired period of overlap time. This may be desirable during the beginning of an intake stroke to allow unburnt fuel from the previous engine cycle, which may have been expelled from the cylinder, to be drawn back into the cylinder with fresh intake air. Another example would be to modify the intake apertures 40, 42 to allow the intake valve to remain open during a portion of the compression stroke. This may be desirable in supercharged engines, so that for a portion of the compression stroke, the piston is compressing against the pressure of the supercharger (Miller-cycle engine) for increased efficiency.

The invention also contemplates using separate and independently adjustable valve shafts for intake and exhaust portions of a cylinder, which will allow for continuously adjustable overlap between the intake valve and the exhaust valve. The invention also contemplates using multiple independently adjustable valve shafts for an intake portion of a cylinder and multiple independently adjustable valve shafts for an exhaust portion of a cylinder.

Figure 30:
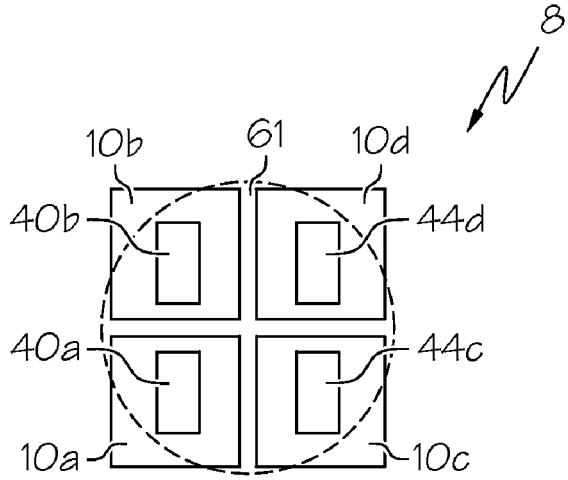
FIG. 30 shows another embodiment of an inventive valve assembly.

FIG. 30 shows a top view of a cylinder 61 and valve assembly 8 having two intake valve portions and two exhaust valve portions. A first intake shaft 10*a* and a second intake shaft 10*b* may each comprise an intake valve. A first exhaust shaft 10*c* and a second exhaust shaft 10*d* may each comprise an exhaust valve. Each valve shaft 10*a*-10*d* may operate as described above with respect to various other embodiments of the invention.

Each shaft 10*a*-10*d* may be arranged to rotate in any suitable direction. For example, the first intake shaft 10*a* may rotate in the same direction or the opposite direction of the rotation of the second intake shaft 10*b*. Similarly, the first exhaust shaft 10*c* may rotate in the same direction or in the opposite direction of the rotation of the first intake shaft 10*a*.

In various embodiments, each valve shaft 10*a*-10*d* may comprise inner and outer shafts. Each valve shaft 10*a*-10*c* may further comprise a switch shaft 54, and may also include a flow path member 56 (see FIG. 28).

The apertures 40*a*-40*d* in the respective valve shafts 10*a*-10*d* may be any suitable dimension. In some embodiments, apertures 40*a* in the first intake shaft 10*a* may be sized differently than aperture 40*b* in the second intake shaft 10*b*. This will allow for a first engine timing via the first intake shaft 10*a* and a second engine timing via the second shaft 10*b*.

In some embodiments, each intake shaft 10*a*, 10*b* may be provided with a switch shaft 54 (see FIG. 28). The engine may operate using only the first intake shaft 10*a* at engine speeds below a predetermined speed, wherein the switch shaft of the first intake shaft 10*a* may be open and the switch shaft of the second intake shaft 10*b* may be closed. Above the predetermined engine speed, the engine may operate using only the second intake shaft 10*b*, wherein the switch shaft of the first intake shaft 10*a* may close and the switch shaft of the second intake shaft 10*b* may open.

In another embodiment, the first valve shaft 10*a* may operate at all engine speeds. A switch shaft of the second intake shaft 10*b* may be closed at engine speeds below a predetermined engine speed. At speeds above the predetermined speed, the switch shaft of the second intake shaft 10*b* may open, and the second intake shaft 10*b* may provide supplemental intake air to the engine. Timing provided by the second intake shaft 10*b* may be different from the timing provided by the first intake shaft 10*a*.

In various embodiments, the number of apertures 40 may vary between the individual shafts 10*a*-10*d*. Further, the rotational speed of the individual shafts 10*a*-10*d* may differ from one another. For example, the first intake shaft 10*a* may have apertures 40 that provide a predetermined engine timing. The second intake shaft 10*b* may have differently sized apertures 40 and/or a greater or lesser number of apertures 40, and may be arranged to rotate at different speeds than the first intake shaft 10*a*.

The exhaust shafts 10*c*, 10*d* may be arranged similarly to the intake shafts 10*a*, 10*b* as described above, to provide for various exhaust timing and flow characteristics.

In some embodiments, each valve shaft 10*a*-10*d* may be rotated by a separate motor that may be computer controlled and may operate independently from the crankshaft. Thus, each valve shaft 10*a*-10*d* may be capable of independent adjustment of both rotational speed and rotational orientation with respect to the crankshaft orientation. Overlap between the two intake valves may be continuously adjusted, as may the overlap between the two exhaust valves. Overlap between the intake valves and the exhaust valves may also be continuously adjusted.

In some embodiments, a valve shaft may include a first valve portion and a second valve portion. Each valve portion may be arranged to provide a different timing for the engine.

Figure 31:
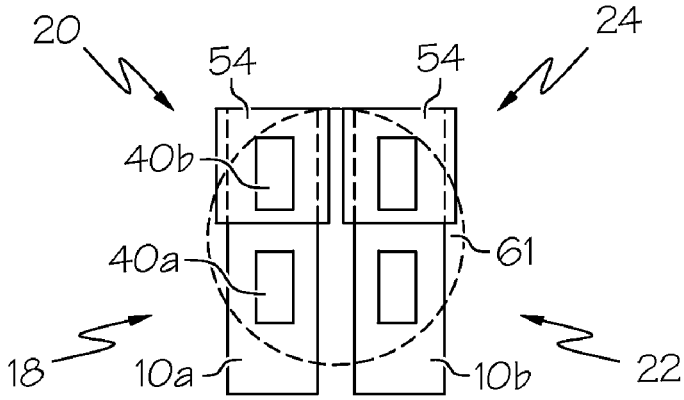
FIG. 31 shows another embodiment of an inventive valve assembly.

FIG. 31 shows an intake valve shaft 10*a* and an exhaust valve shaft 10*b*. The intake valve shaft 10*a* may have a first intake valve portion 18 and a second intake valve portion 20. Each intake valve portion 18, 20 may be arranged to supply intake air to an engine cylinder 61. Intake apertures 40*a* of the first intake valve portion 18 may be arranged to supply the engine with a first timing. Intake apertures 40*b* of the second intake valve portion 20 may be arranged to supply the engine with a second timing. The first timing of the first intake valve portion 18 may provide a shorter cycle than the second timing of the second intake valve portion 20. For example, the first intake valve portion 18 may be arranged to provide a 180° cycle, while the second intake valve portion 20 may be arranged to provide a 210° cycle. Thus, the circumferential width of the apertures 40*a* of the first intake valve portion 18 may be less than the circumferential width of the apertures 40*b* of the second intake valve portion 20.

Desirably, at least one of the intake valve portions 18, 20 may be provided with a switch shaft 54 as described herein. FIG. 31 shows a switch shaft 54 on the second intake valve portion 20. The switch shaft 54 allows the second intake valve portion 20 to remain closed regardless of rotational orientation of the intake valve shaft 10*a*, and allows opening of the second intake valve portion 20 only when desired, such as at high engine speeds. For example, the first intake valve portion 18 may be arranged for normal operation at all engine speeds, while the second intake valve portion 20 may be arranged to open only at high engine speeds above a predetermined engine speed to provide a supplemental flow path for the intake air. Thus, the engine timing provided by the first intake valve portion 18 may be optimized for low engine speeds, while the engine timing provided by the second intake valve portion 20 may be optimized for high engine speeds.

The exhaust valve shaft 10*b* may include a first exhaust valve portion 22 and a second exhaust valve portion 24. The first exhaust valve portion 22 and the second exhaust valve portion 24 may be configured for operation similar to the operation of the first intake valve portion 18 and the second intake valve portion 20 as described above but applied to exhaust flow out of the cylinder 61.

The intake valve shaft 10*a* and the exhaust valve shaft 10*b* may be configured to rotate in the same direction or in opposite directions.

Any feature disclosed herein with respect to any embodiment may be used on any other embodiment of the invention. Valve assemblies 8 as described herein may be configured for any suitable use, such as for an intake valve or an exhaust valve. Valve shafts 10 may be configured to rotate in either direction about the longitudinal axis of the valve shaft 10, and may rotate in the same direction or the opposite direction as other valve shafts 10 included in the device. Any valve shaft 10 described herein may comprise inner and outer concentric shafts as described herein. Any valve shaft 10 described herein may include a switch shaft 54 and/or a flow path member 56.

Engines according to the invention may be provided with any number of valves in communication with a given cylinder, including any number of intake valves and any number of exhaust valves. The number of intake valves may be the same as the number of exhaust valves, or there may be more intake valves than exhaust valves, or more exhaust valves than intake valves.

A single valve shaft 10 may include any number of individual valves, which may be intake valves, exhaust valves, or a combination of intake valves and exhaust valves. Various valves may be arranged to provide the engine with various timing cycles.

Embodiments of an inventive valve assembly 8 may be used on any suitable internal combustion engine, such as gasoline and diesel engines, and including but not limited to Otto-cycle, Miller-cycle and rotary engines.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also being specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim, if such multiple dependent format is an accepted format within the jurisdiction (for example, each claim depending directly from claim 1 should be alternatively taken as depending from all previous claims). In jurisdictions where multiple dependent claim formats are restricted, the dependent claims should each be also taken as alternatively written in each singly dependent claim format which creates a dependency from a prior antecedent-possessing claim other than the specific claim listed in such dependent claims below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A valve assembly for an internal combustion engine comprising:

a shaft assembly comprising a first rotatable shaft and a second rotatable shaft oriented concentrically within the first rotatable shaft, each rotatable shaft comprising a plurality apertures such that the shaft assembly defines a first intake valve portion, a second intake valve portion and an exhaust valve portion, the shaft assembly arranged to rotate according to the speed of an engine such that during a piston intake stroke, the first intake valve portion and the second intake valve portion are in fluid communication with a cylinder and allow air to enter the cylinder, and during a piston exhaust stroke, the exhaust valve portion is in fluid communication with the cylinder and allows exhaust to exit the cylinder.

2. A valve assembly for an internal combustion engine comprising:

a shaft assembly comprising a first rotatable shaft and a second rotatable shaft, the shaft assembly defining a first intake fluid passageway, a second intake fluid passageway and an exhaust fluid passageway, the second rotatable shaft oriented concentrically within the first rotatable shaft, wherein the first rotatable shaft is arranged to rotate according to the speed of an engine such that during a piston intake stroke, the first intake fluid passageway and second intake fluid passageway are in communication with a cylinder and allow air to enter the cylinders, and during a piston exhaust stroke, the exhaust fluid passageway is in communication with the cylinder and allows exhaust to exit the cylinder.

3. The valve assembly of claim 2, wherein the first intake fluid passageway is not in communication with the cylinder during piston compression, combustion or exhaust strokes.

4. The valve assembly of claim 2, wherein the exhaust fluid passageway is not in communication with the cylinder during piston intake, compression, or combustion strokes.

5. The valve assembly of claim 2, wherein the first rotatable shaft is rotatably supported by an engine head, and intake air is arranged to pass through the head and first and second rotatable shafts when the first intake fluid passageway is in communication with the cylinder open.

6. The valve assembly of claim 2, wherein a longitudinal axis of the first rotatable shaft is orthogonal to a longitudinal axis of the cylinder.

7. The valve assembly of claim 2, wherein the second rotatable shaft is arranged to rotate at ½ the speed of the first rotatable shaft.

8. The valve assembly of claim 2, wherein the first rotatable shaft comprises a wall portion, a hollow interior portion, a first aperture in the wall portion in communication with the hollow interior portion, and a second aperture in the wall portion in communication with the hollow interior portion.

9. The valve assembly of claim 8, wherein when the valve is closed, the wall portion prevents fluid flow from reaching a cylinder.

10. The valve assembly of claim 2, further comprising a switch shaft oriented concentrically around the first rotatable shaft, the switch shaft having a wall portion and a fluid pathway extending therethrough, wherein the switch shaft is arranged to selectively block fluid communication with the cylinder.

11. The valve assembly of claim 2, further comprising a stationary flow path member oriented within the second rotatable shaft, the stationary flow path member having a flow pathway extending therethrough.

12. The valve assembly of claim 2, wherein the first intake fluid passageway comprises a first intake valve portion, and the second intake fluid passageway comprises a second intake valve portion.

13. The valve assembly of claim 12, wherein the second intake valve portion remains open longer than the first intake valve portion.

14. The valve assembly of claim 12, wherein the second intake valve portion further comprises a switch shaft oriented concentrically around the first rotatable shaft, the switch shaft having a wall portion and a fluid pathway extending therethrough, wherein the switch shaft is arranged to selectively block fluid communication between the second valve portion and the cylinder at engine speeds under a predetermined engine speed.

15. A valve assembly for an internal combustion engine comprising:

a first rotatable shaft comprising a wall surface and a first fluid pathway extending therethrough;

a second rotatable shaft comprising a wall surface and a second fluid pathway extending therethrough, the second rotatable shaft oriented concentrically within the first rotatable shaft; and a switch shaft oriented concentrically around the first rotatable shaft, the switch shaft having a wall portion and a third fluid pathway extending therethrough;

wherein the valve assembly is open when the first fluid pathway, second fluid pathway and third fluid pathway are positioned to allow fluid communication with a cylinder.

16. The valve assembly of claim 15, wherein the valve assembly is closed when either the first fluid pathway or the second fluid pathway is not positioned to allow fluid communication with a cylinder.

17. The valve assembly of claim 16, wherein the valve assembly is open during a piston intake stroke, and the valve assembly is closed during piston compression, combustion or exhaust strokes.

18. The valve assembly of claim 15, wherein the first fluid pathway comprises a first aperture and a second aperture through the wall surface of the first rotatable shaft, and the second fluid pathway comprises a third aperture and a fourth aperture through the wall surface of the second rotatable shaft.

19. The valve assembly of claim 18, wherein the first aperture and the second aperture are located on opposite sides of a longitudinal axis of the first rotatable shaft.

20. The valve assembly of claim 19, wherein the first aperture and the second aperture each extend 45° around the circumference of the first rotatable shaft.

21. The valve assembly of claim 18, wherein the third aperture and the fourth aperture are located on opposite sides of a longitudinal axis of the second rotatable shaft.

22. The valve assembly of claim 21, wherein the third aperture and the fourth aperture each extend 90° around the circumference of the second rotatable shaft.

23. The valve assembly of claim 15, wherein the first fluid pathway extends in a direction orthogonal to a longitudinal axis of the first rotatable shaft; and the second fluid pathway extends in a direction orthogonal to a longitudinal axis of the second rotatable shaft.

24. The valve assembly of claim 15, wherein the second rotatable shaft is arranged to rotate at ½ the rate of the first rotatable shaft.

25. The valve assembly of claim 24, wherein the first rotatable shaft is arranged to rotate at ½ the rate of an engine crankshaft.

26. The valve assembly of claim 15, wherein the first rotatable shaft further comprises a first exhaust fluid pathway extending in a direction orthogonal to both the longitudinal axis of the first rotatable shaft and the first fluid pathway;

the second rotatable shaft further comprises a second exhaust fluid pathway extending in a direction orthogonal to both the longitudinal axis of the second rotatable shaft and the second fluid pathway;

wherein an exhaust portion of the valve assembly is open when the first exhaust fluid pathway and second exhaust fluid pathway are in communication with the cylinder.

27. The valve assembly of claim 26, wherein the exhaust portion of the valve assembly is open during a piston exhaust stroke, and the exhaust portion of the valve assembly is closed during piston intake, compression and combustion strokes.

28. The valve assembly of claim 15, wherein the first rotatable shaft is rotatably supported by an engine head.

29. The valve assembly of claim 28, wherein the first rotatable shaft is contained between an upper head portion and a lower head portion.

30. The valve assembly of claim 15, wherein the first rotatable shaft and the second rotatable shaft rotate in opposite directions.

31. The valve assembly of claim 15, wherein the switch shaft is arranged to selectively block fluid communication with the cylinder independently of the first and second rotatable shafts.

32. The valve assembly of claim 15, further comprising a stationary flow path member oriented within the second rotatable shaft, the stationary flow path member having a flow pathway extending therethrough.

33. A valve assembly for an engine comprising:

a rotatable intake shaft assembly comprising a first rotatable intake shaft, a second rotatable intake shaft and a rotatable intake switch shaft, the second rotatable intake shaft oriented concentrically within the first rotatable intake shaft, the rotatable intake switch shaft oriented concentrically around the first rotatable intake shaft, each rotatable intake shaft comprising a cylindrical wall surface having a plurality of apertures therethrough, the rotatable intake shaft assembly defining a first intake fluid passageway comprising a first intake valve, wherein the first intake valve is open when the first intake fluid passageway is oriented to allow fluid communication with a cylinder;

a rotatable exhaust shaft assembly defining a first exhaust fluid passageway comprising an exhaust valve, wherein the exhaust valve is open when the first exhaust fluid passageway is oriented to allow fluid communication with the cylinder;

wherein the intake shaft assembly is rotatable separately from the exhaust shaft assembly.

34. The valve assembly of claim 33, wherein the rotatable intake switch shaft is rotatable separately from the first rotatable intake shaft.

35. The valve assembly of claim 33, wherein the rotatable exhaust shaft assembly comprises a first rotatable exhaust shaft and a second rotatable exhaust shaft oriented concentrically within the first rotatable exhaust shaft, each rotatable exhaust shaft comprising a cylindrical wall surface having a plurality of apertures therethrough.

36. The valve assembly of claim 34, wherein the rotational orientation of the rotatable intake switch shaft may be adjusted independently from the rotational orientation of the second rotatable intake shaft.

37. The valve assembly of claim 33, wherein the rotatable intake shaft assembly further comprises a second intake fluid passageway comprising a second intake valve, wherein the second intake valve is open when the second intake fluid passageway is oriented to allow fluid communication with the cylinder.

38. The valve assembly of claim 37, wherein the second intake valve remains open longer than the first intake valve.

39. The valve assembly of claim 37, wherein the rotational orientation of the rotatable intake switch shaft does not affect the second intake valve.

40. The valve assembly of claim 33, wherein the rotatable exhaust shaft assembly further comprises a second exhaust fluid passageway comprising a second exhaust valve, wherein the second exhaust valve is open when the second exhaust fluid passageway is oriented to allow fluid communication with the cylinder.

41. The valve assembly of claim 40, wherein the second exhaust valve remains open longer than the first exhaust valve.

42. The valve assembly of claim 35, wherein the rotatable exhaust shaft assembly further comprises a rotatable exhaust switch shaft oriented concentrically around the first rotatable exhaust shaft.

43. The valve assembly of claim 37, wherein the engine timing provided by the first intake valve is different than the engine timing provided by the second intake valve.

44. The valve assembly of claim 40, wherein the engine timing provided by the first exhaust valve is different than the engine timing provided by the second exhaust valve.

* * * * *